US009963990B2

(12) United States Patent
Vetters et al.

(10) Patent No.: US 9,963,990 B2
(45) Date of Patent: May 8, 2018

(54) CERAMIC MATRIX COMPOSITE SEAL SEGMENT FOR A GAS TURBINE ENGINE

(71) Applicants: Daniel Kent Vetters, Indianapolis, IN (US); David J. Thomas, Brownsburg, IN (US); Ted Freeman, Danville, IN (US); Douglas David Dierksmeier, Franklin, IN (US); Jun Shi, Carmel, IN (US); Todd Engel, Long Beach, CA (US)

(72) Inventors: Daniel Kent Vetters, Indianapolis, IN (US); David J. Thomas, Brownsburg, IN (US); Ted Freeman, Danville, IN (US); Douglas David Dierksmeier, Franklin, IN (US); Jun Shi, Carmel, IN (US); Todd Engel, Long Beach, CA (US)

(73) Assignees: Rolls-Royce North American Technologies, Inc., Indianapolis, IN (US); Rolls-Royce Corporation, Indianapolis, IN (US); Rolls-Royce High Temperature Composites, Inc., Huntington Beach, CA (US)

( * ) Notice: Subject to any disclaimer, the term of this patent is extended or adjusted under 35 U.S.C. 154(b) by 353 days.

(21) Appl. No.: 14/721,705

(22) Filed: May 26, 2015

(65) Prior Publication Data

US 2016/0348528 A1 Dec. 1, 2016

(51) Int. Cl.

| | |
|---|---|
| ***F01D 11/08*** | (2006.01) |
| ***F01D 25/24*** | (2006.01) |
| ***F01D 9/04*** | (2006.01) |

(52) U.S. Cl.

CPC ..... *F01D 11/08* (2013.01); *F01D 9/04* (2013.01); *F01D 25/24* (2013.01); *F01D 25/246* (2013.01);

(Continued)

(58) Field of Classification Search

CPC ... F01D 9/02; F01D 9/04; F01D 11/08; F01D 25/243; F01D 25/246; F01D 11/02;

(Continued)

(56) References Cited

U.S. PATENT DOCUMENTS 5,591,003 A * 1/1997 Boyd ..... F01D 9/042 415/209.2

6,042,315 A 3/2000 Miller et al.

(Continued)

FOREIGN PATENT DOCUMENTS

| | | |
|---|---|---|
| EP | 2357322 A2 | 8/2011 |
| EP | 2690260 A2 | 1/2014 |

OTHER PUBLICATIONS

European Patent Office , Partial European Search Report for corresponding EP Application No. 16171446 dated Nov. 2, 2016, 1pg.

(Continued)

*Primary Examiner* — Dwayne J White
*Assistant Examiner* — Sang K Kim
(74) *Attorney, Agent, or Firm* — Duane Morris LLP

(57) ABSTRACT

A ceramic matrix composite (CMC) seal segment for use in a segmented turbine shroud for radially encasing a turbine in a gas turbine engine. The CMC seal segment comprises an arcuate flange having a surface facing the turbine and a portion defining a bore for receiving an elongated pin, with the bore having a length that is at least 70% of the length of the elongated pin received therein. The CMC seal segment is carried by the carrier by at least one of the elongated pins being received within the bore. The CMC seal segment portion defining a pin-receiving bore is radially spaced from the arcuate flange by a spacing flange extending radially outward from the arcuate flange.

16 Claims, 41 Drawing Sheets

(52) U.S. Cl.
CPC ..... *F05D 2220/32* (2013.01); *F05D 2240/24* (2013.01); *F05D 2300/6033* (2013.01)

(58) Field of Classification Search
CPC .... F01D 25/005; F01D 25/24; F05D 2240/11; F05D 2220/32; F05D 2240/24; F05D 2240/55; F05D 2250/15; F05D 2260/30; F05D 2260/38; F05D 2300/6033
See application file for complete search history.

(56) References Cited

U.S. PATENT DOCUMENTS 6,045,310 A 4/2000 Miller et al.
6,648,597 B1 * 11/2003 Widrig ..... F01D 9/044 415/200
6,773,215 B2 8/2004 Cuva et al.
6,830,437 B2 12/2004 Cairo et al.
6,884,026 B2 4/2005 Glynn et al.
7,044,709 B2 5/2006 Bruce et al.
7,117,983 B2 10/2006 Good et al.
7,278,820 B2 10/2007 Keller
7,416,362 B2 8/2008 North
7,434,670 B2 10/2008 Good et al.
7,494,317 B2 2/2009 Keller et al.
7,563,071 B2 7/2009 Campbell et al.
7,581,399 B2 9/2009 Farah et al.
7,722,317 B2 5/2010 Schiavo et al.
7,726,936 B2 6/2010 Keller et al.
7,874,059 B2 1/2011 Morrison et al.
7,950,234 B2 5/2011 Radonovich et al.
7,988,395 B2 8/2011 Steffier
8,047,773 B2 11/2011 Bruce et al.
8,070,431 B2 12/2011 Harter et al.
8,118,546 B2 2/2012 Morrison
8,256,088 B2 9/2012 James et al.
8,459,042 B2 6/2013 Lohmueller
8,607,577 B2 12/2013 Sanchez et al.
8,616,801 B2 12/2013 Morrison et al.
8,740,552 B2 6/2014 Marusko et al.
8,790,067 B2 7/2014 McCaffrey et al.
8,905,709 B2 12/2014 Dziech et al.
8,926,270 B2 1/2015 Karafillis et al.
8,932,009 B2 1/2015 Moraines et al.
8,998,565 B2 4/2015 Foster et al.
2004/0062639 A1 4/2004 Glynn et al.
2007/0031258 A1 2/2007 Campbell et al.
2012/0260670 A1 10/2012 Foster et al.
2014/0030072 A1 1/2014 Hillier et al.
2014/0271147 A1 * 9/2014 Uskert ..... F01D 11/24 415/173.2
2014/0294572 A1 * 10/2014 Hillier ..... F01D 11/122 415/173.6
2015/0377035 A1 * 12/2015 Freeman ..... F01D 11/12 416/191
2016/0305265 A1 * 10/2016 Stapleton ..... F04D 29/321

OTHER PUBLICATIONS https://www.precisionballs.com/Flexures.php Jun. 3, 2015, 17pgs.

* cited by examiner

CERAMIC MATRIX COMPOSITE SEAL SEGMENT FOR A GAS TURBINE ENGINE

FIELD OF THE DISCLOSURE

The present disclosure relates generally to gas turbine engines, and more specifically to shrouds that radially encompass the turbine in gas turbine engines.

BACKGROUND

Gas turbine engines are capable of higher efficiencies when operated at higher temperatures. However, operation of the engine at such higher temperatures may negatively affect the properties of metal components traditionally used in gas turbine engines. Even with the introduction of complex cooling systems, there remains a practical maximum operating temperature for gas turbine engines constructed primarily from metal alloys and, consequently, a ceiling on the efficiency of such engines.

One alternative to improve the efficiency of gas turbine engines is to use ceramic matrix composite (CMC) materials for certain components in the engine that have traditionally been formed from metal alloys. CMC materials are not as susceptible as metallic components to the degradation of material properties caused by the high operating temperatures that are desired to improve the efficiency of the engine. However, despite favorable thermal properties of the CMC material components, the CMC material components have an allowable stress which is an order of magnitude lower than the component formed from metal alloys, a high degree of stiffness, and a significantly lower thermal expansion rate than metallic components, leading to poor load distribution at transfer points. With these limitations, CMC material components cannot merely be substituted for equivalent metal alloy components of identical geometric structures and subjected to the same pressure loading without exceeding the allowable stresses of the CMC material.

Despite these limitations, the advantages of CMC materials in high temperature applications have led to their limited use in gas turbine components such as turbine blade track sealing segments. Circumferentially surrounding a rotating turbine blade wheel, a static blade track sealing shroud is designed to maximize the working air flowing through the turbine blades by minimizing the amount of air which leaks by the blade tips, thereby increasing the efficiency of the engine. Such sealing shrouds are frequently composed of a plurality of segments positioned around the turbine axis. Due to the segmented nature of the shroud, the shroud requires seals between the segments in order to block air from escaping the working air flow path through any potential segment-to-segment gaps.

A typical CMC sealing segment comprises a u-shaped component. The thin, flanged edges of the u-shaped sealing segment are machined with holes and slots for mounting pin attachment. While machining CMC materials is not desirable as they are susceptible to shorter lifespans due to recession in the hot, humid gas turbine environment, the u-shaped design requires machining of holes and, in particular, a slot to allow relative motion between the CMC sealing segment and metal alloy support structures due to different rates of thermal expansion between these materials. Additional machining of u-shaped CMC segments is required to support inter-segment seals. Further, using thin walls in the sealing segment subjects the CMC material to high edge loading stresses due to the small contact area between the CMC wall and the mounting pin. These high stresses severely limit any residual load capacity in the CMC material such that it is limited to use in low pressure applications.

There exists a need for novel CMC structures and mounting techniques which allow the use of CMC materials in high pressure, high temperature gas turbine seal segment applications.

SUMMARY OF THE DISCLOSURE

The present application discloses one or more of the features recited in the appended claims and/or the following features which, alone or in any combination, may comprise patentable subject matter.

According to an aspect of the present disclosure, a segmented turbine shroud for radially encasing a turbine in a gas turbine engine comprises a carrier, a ceramic matrix composite (CMC) seal segment comprising an arcuate flange having a surface facing the turbine and a portion defining a bore for receiving an elongated pin, and one or more elongated pins. The CMC seal segment is carried by the carrier by at least one of the elongated pins being received within the bore, and the CMC seal segment portion defining a pin-receiving bore is radially spaced from the arcuate flange by a spacing flange extending radially outward from the arcuate flange, and wherein the CMC seal segment portion defines a bore having a length that is at least 70% of the length of the elongated pin received therein.

In some embodiments, the pin receiving bore has a length that is at least 80% of the length of the elongated pin received therein. In some embodiments, the pin receiving bore has a length that is at least 75% of a parallel dimension of the arcuate flange. In some embodiments, the pin receiving bore has a length that is at least 90% of a parallel dimension of the arcuate flange. In some embodiments, the elongated pin passes through only a single pin-receiving bore of the CMC seal segment.

According to an aspect of the present disclosure, a segmented turbine shroud radially encasing a turbine in a gas turbine engine comprises a carrier and a ceramic matrix composite (CMC) seal segment carried by said carrier by a plurality of elongated pins. The CMC seal segment comprises an arcuate flange having an inner surface facing the turbine, an opposing outer surface, and a plurality of radial members extending radially away from the outer surface, each of the radial members defining an elongated pin-receiving bore at the distal end thereof. A radial dimension of the arcuate flange being a dimension between the inner surface and the opposing outer surface, each of the radial members defines a pin-receiving bore having a length greater than the minimum radial dimension of the arcuate flange.

In some embodiments, each of the radial members defines a bore that is radially spaced from the outer surface of the arcuate flange a distance greater than the minimum radial dimension of the arcuate flange. In some embodiments, each of the radial members defines a bore that is radially spaced from the outer surface of the arcuate flange a distance greater than twice the minimum radial dimension of the arcuate flange. In some embodiments, at least one of said radial members defines a pin-receiving bore comprising a circular lateral cross-section.

In some embodiments, the CMC seal segment comprises at least three radial members defining pin-receiving bores. In some embodiments, at least one of the radial members defines a pin-receiving bore having a length that is at least 70% of the length of an elongated pin received therein. In some embodiments, at least one of the radial members defines a pin-receiving bore comprising a lateral cross-section dimension of at least three-eighths inches. In some embodiments, at least one of the radial members defines a pin-receiving bore comprising a lateral cross-section dimension that varies along the length of the bore.

According to an aspect of the present disclosure, a segmented turbine shroud for radially encasing a turbine in a gas turbine engine comprises a carrier comprising a plurality of portions each defining a pin-receiving carrier bore; a ceramic matrix composite (CMC) seal segment comprising a plurality of portions each defining a pin-receiving seal segment bore; and a plurality of elongated pins. Each of the elongated pins passes through at least a carrier bore and a seal segment bore to thereby mount the CMC seal segment to the carrier, and at least one of the elongated pins passes through only a single seal segment bore.

BRIEF DESCRIPTION OF THE DRAWINGS

The following will be apparent from elements of the figures, which are provided for illustrative purposes and are not necessarily to scale.

Figure 1:
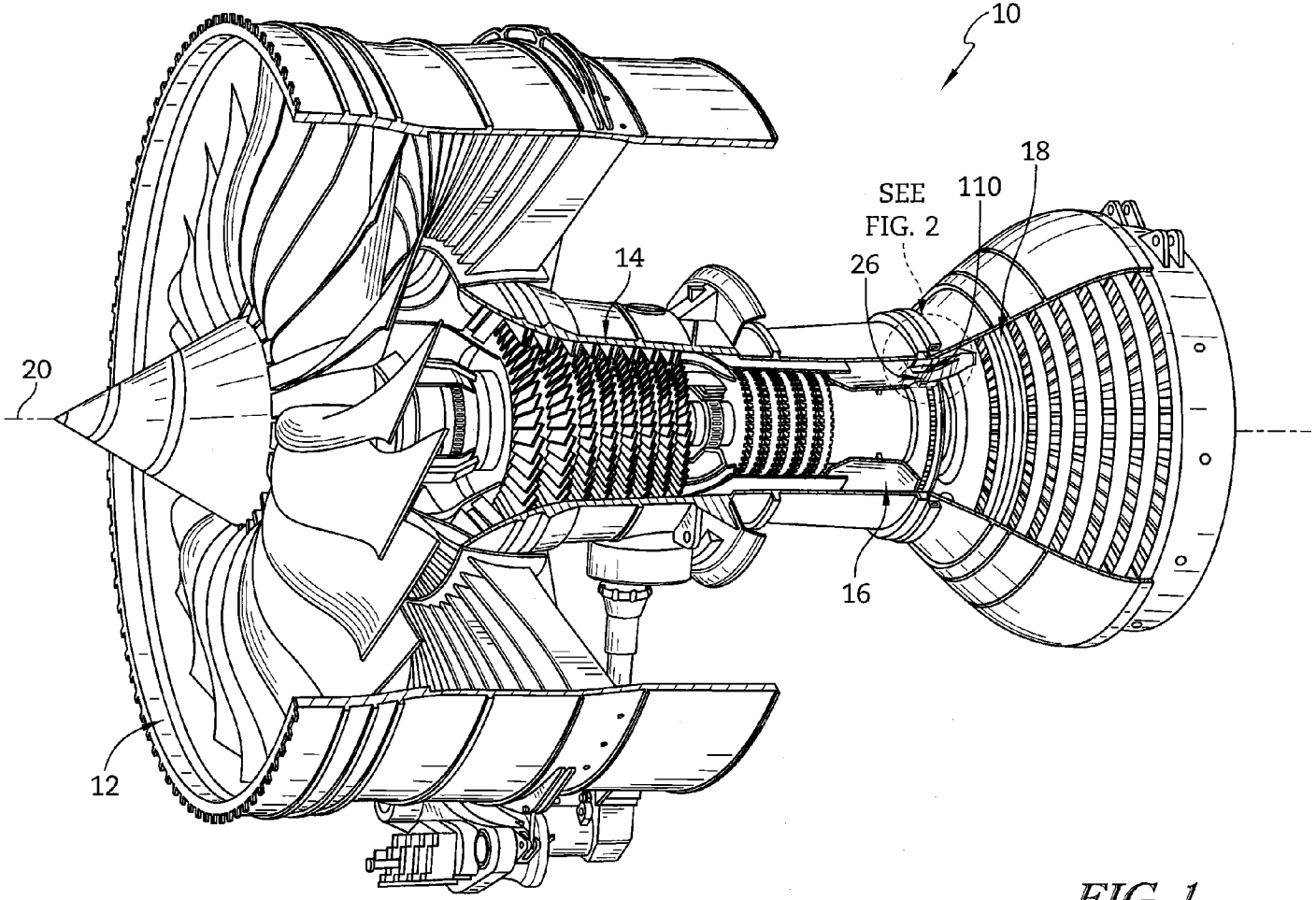
FIG. 1 is a cutaway perspective view of a gas turbine engine.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION OF THE DRAWINGS

For the purposes of promoting an understanding of the principles of the disclosure, reference will now be made to a number of illustrative embodiments illustrated in the drawings and specific language will be used to describe the same.

This disclosure presents numerous embodiments to overcome the aforementioned deficiencies of CMC components when used in gas turbine engines. More specifically, this disclosure is directed to gas turbine shrouds which accommodate the low stress allowable, high stiffness, and lower thermal expansion of CMC components when compared to traditional metal alloy components.

An illustrative aerospace gas turbine engine cut-away in FIG. 1 to show that the engine 10 includes a fan 12, a compressor 14, a combustor 16, and a turbine 18. The fan 12 is driven by the turbine 18 and provides thrust for propelling an air vehicle (not shown). The compressor 14 compresses and delivers air to the combustor 16. The combustor 16 mixes fuel with the compressed air received from the compressor 14 and ignites the fuel. The hot, high-pressure products of the combustion reaction in the combustor 16 are directed into the turbine 18 to cause the turbine 18 to rotate about an axis 20 and drive the compressor 14 and the fan 12.

Figure 2:
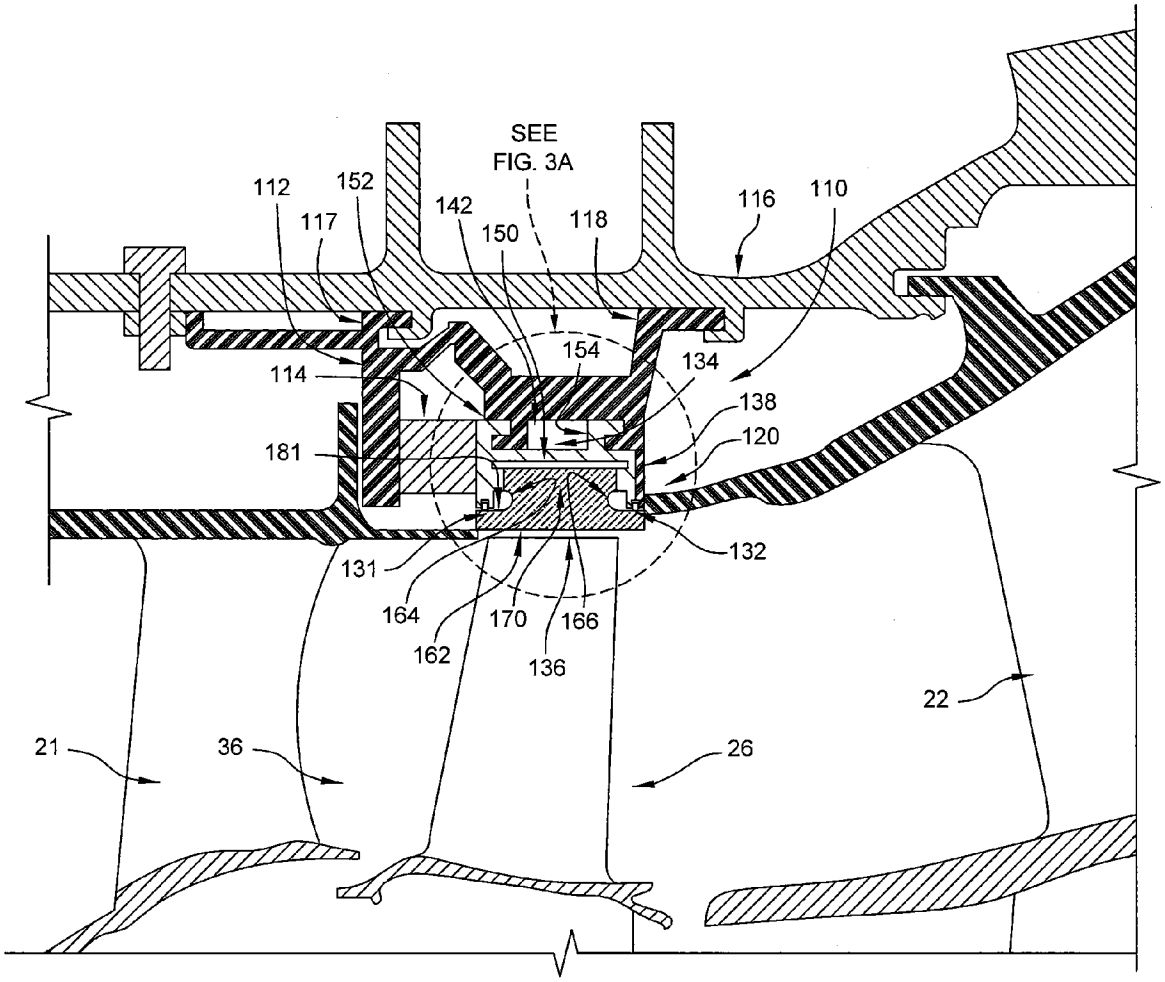
FIG. 2 is a partial axial cross-sectional view of the gas turbine engine of FIG. 1 showing the arrangement of a segmented turbine shroud.

Referring now to FIG. 2, a portion of the turbine 18 is shown to include static turbine vane assemblies 21, 22 and a turbine wheel assembly 26. The vane assemblies 21, 22 extend across the flow path of the hot, high-pressure combustion products from the combustor 16 to direct the combustion products toward blades 36 of the turbine wheel assembly 26. The blades 36 are in turn pushed by the combustion products to cause the turbine wheel assembly 26 to rotate, thereby driving the rotating components of the compressor 14 and the fan 12.

The turbine 18 also includes a turbine shroud 110 that extends around turbine wheel assembly 26 to block combustion products from leaking past the blades 36 without pushing the blades 36 to rotate the wheel assembly 26 as shown in FIG. 2. Combustion products that are allowed to leak by the blades 36 do not push the blades 36 and such leaked combustion products contribute to lost performance within the engine 10.

The turbine shroud 110 illustratively includes a mount ring 112, a retainer ring 114, and a plurality of shroud segments 120 as shown in FIG. 2. The plurality of shroud segments 120 are illustratively assemblies that are arranged circumferentially adjacent to one another to form a ring around the turbine wheel assembly 26. The mount ring 112 is coupled to a turbine case 116 by a pair of L-shaped hanger brackets 117, 118 and supports the plurality of shroud segments 120. The retainer ring 114 engages the mount ring 112 and the plurality of shroud segments 120 to hold the shroud segments 120 in place relative to the mount ring 112. The shroud segments 120 are supported relative to the turbine case 116 by the mount ring 112 and retainer ring 114 in position adjacent to the blades 36 of the turbine wheel assembly 26. In other embodiments, the shroud segments 120 may be coupled directly to the turbine case 116 or may be supported relative to the turbine case 116 by another suitable arrangement.

Sealed Shroud Segments

Figure 3A:
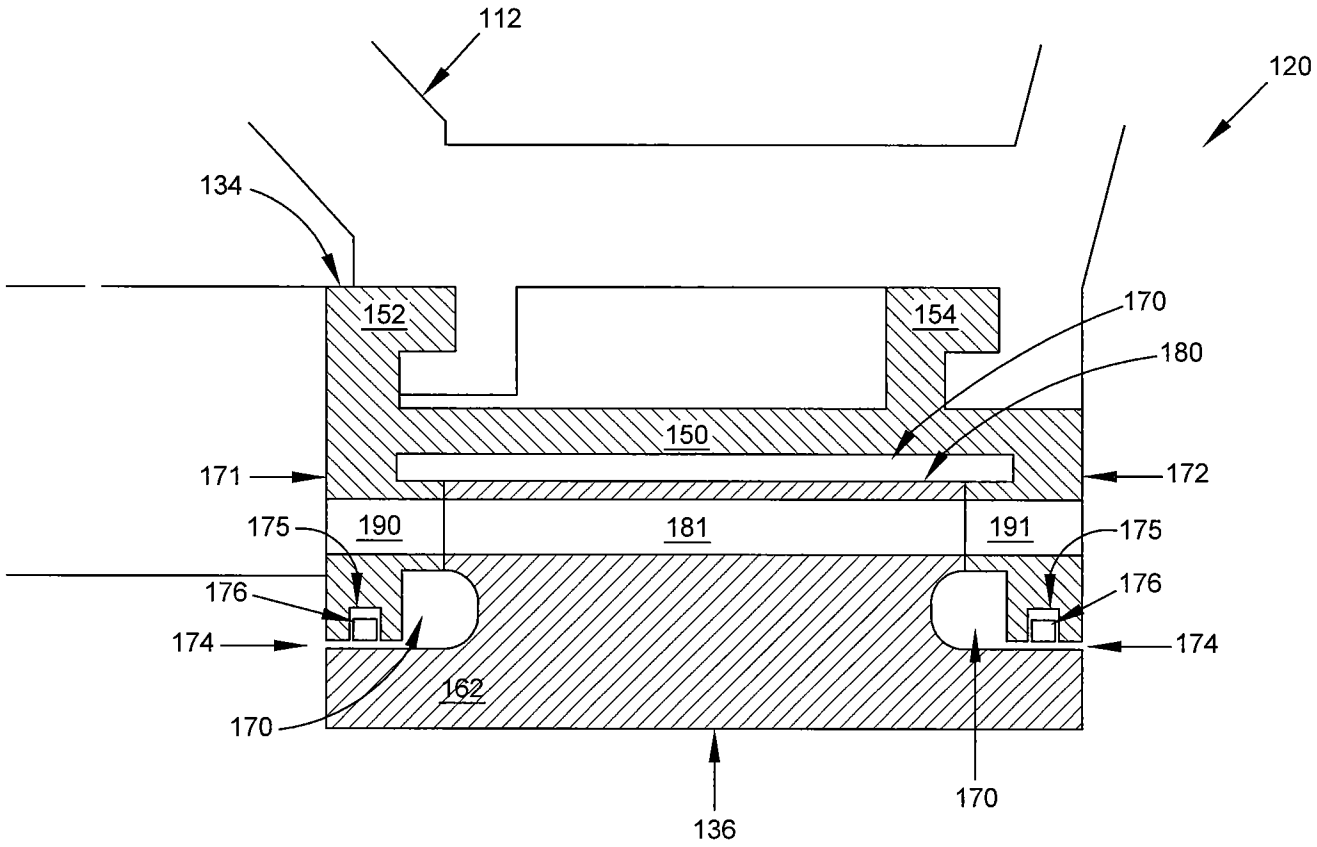
FIG. 3A is a detailed axial cross-sectional view of a portion of FIG. 2 showing a shroud segment comprising a carrier segment and CMC seal segment.

One embodiment of the present disclosure is directed to a system and method for reducing the radial pressure load on a CMC seal segment in a turbine shroud segment. As illustrated in FIGS. 3A and 4A, each shroud segment 120—which may be referred to as a "cartridge"—comprises a carrier segment 134 and a CMC seal segment 136. FIGS. 3A through 3E and 4A through 4E provide examples of the various geometries of a carrier segment 134 and a CMC seal segment 136 which may be used in sealing a shroud segment 120, although the disclosed shroud segments 120 are not limited to the illustrated embodiments.

Figure 3B:
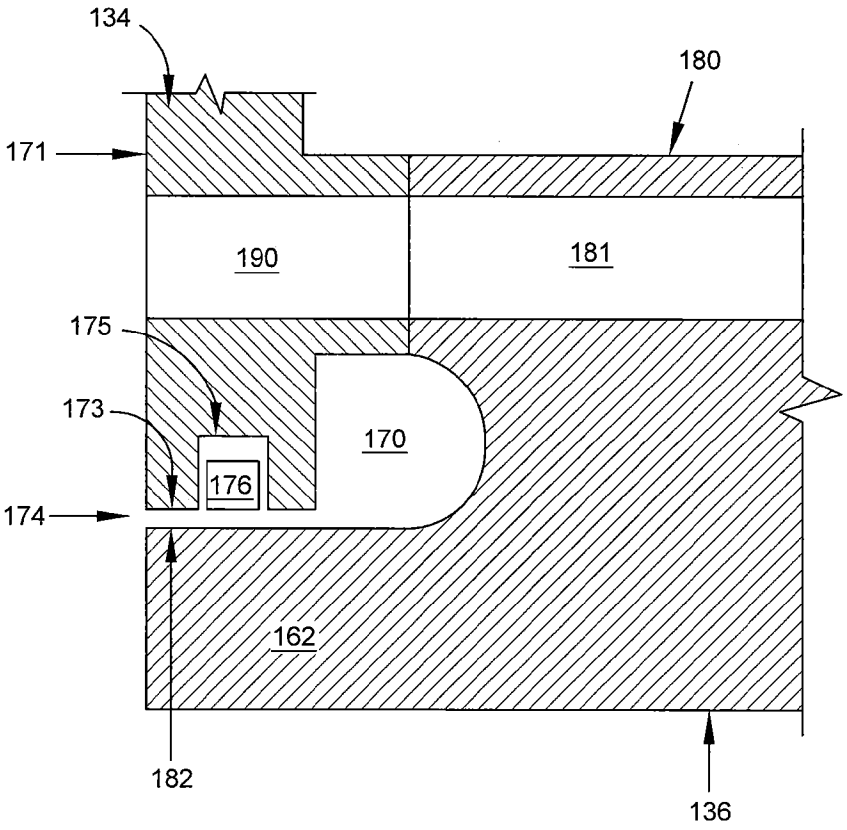
FIG. 3B is a detailed axial cross-sectional view of the mating region of the shroud segment of FIG. 3A.
Figure 3C:
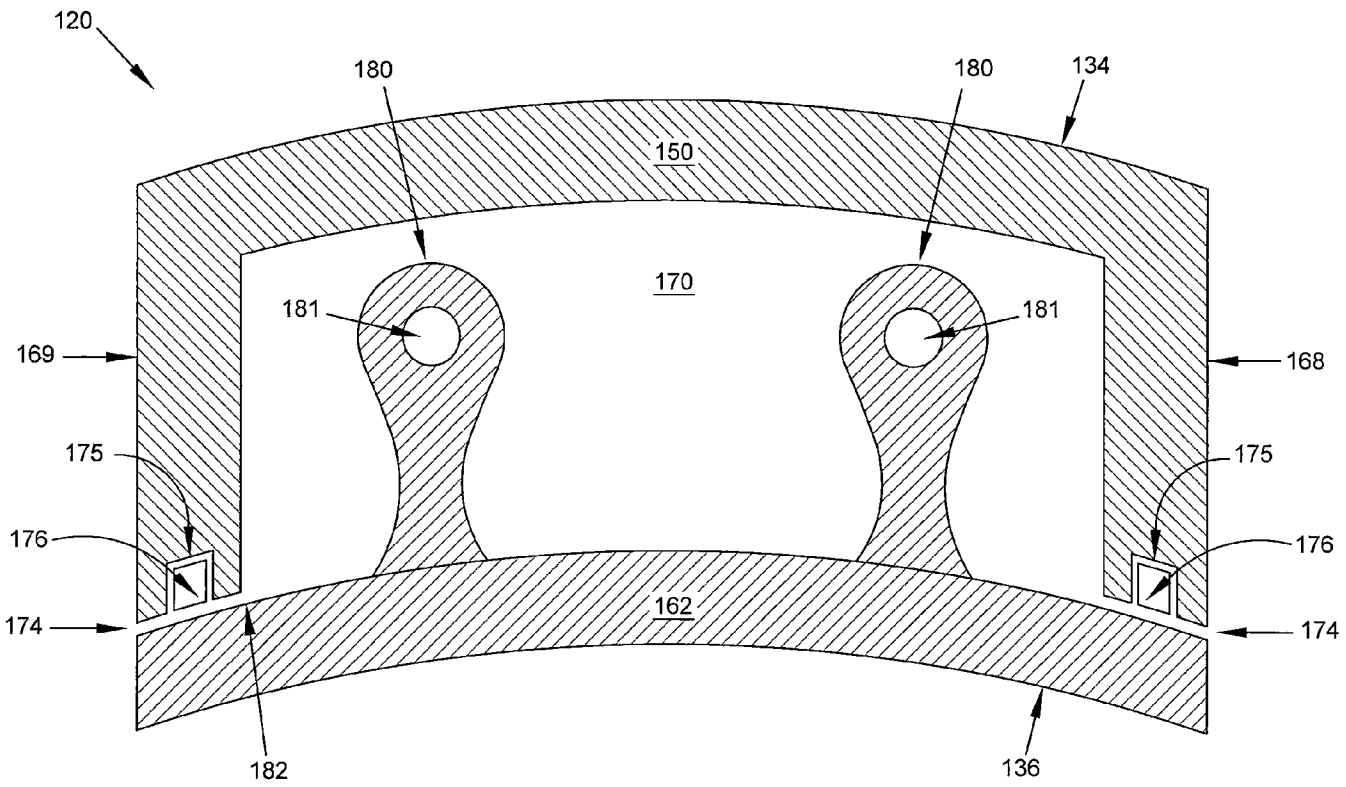
FIG. 3C is a radial cross-sectional view of the shroud segment of FIG. 3A.
Figure 3D:
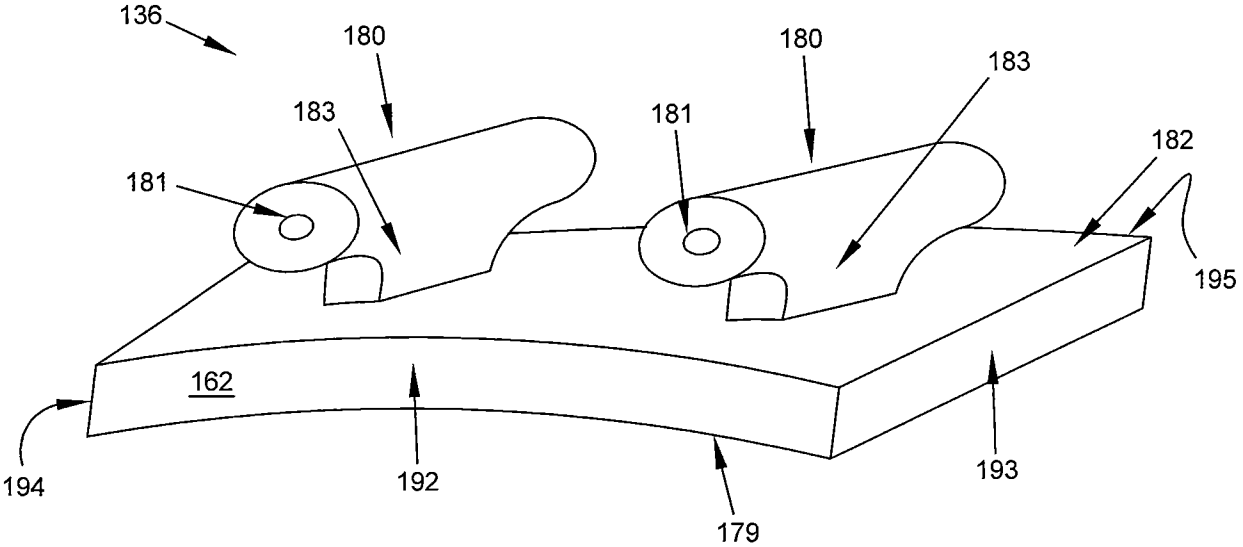
FIG. 3D is a perspective view of CMC seal segment having at least one pin bore flange.
Figure 3E:
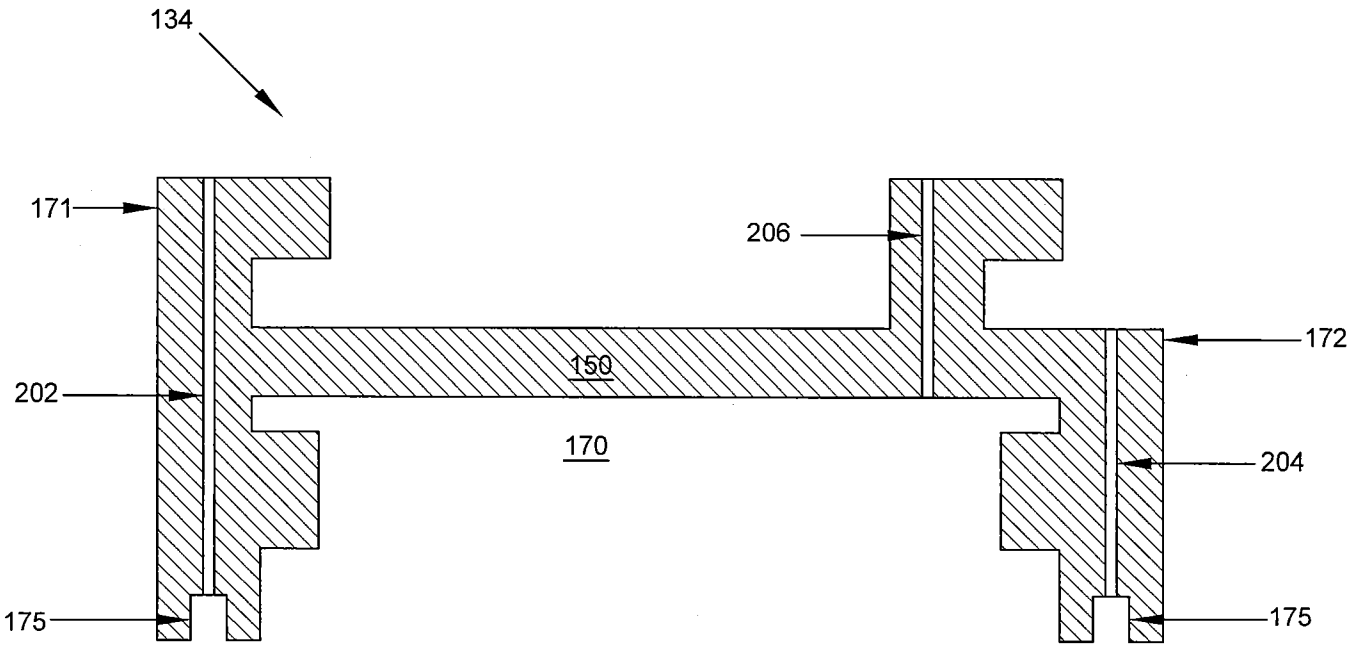
FIG. 3E is an axial cross-sectional view of the carrier segment shown in FIG. 3A illustrating pressurized air conduits.
Figure 4A:
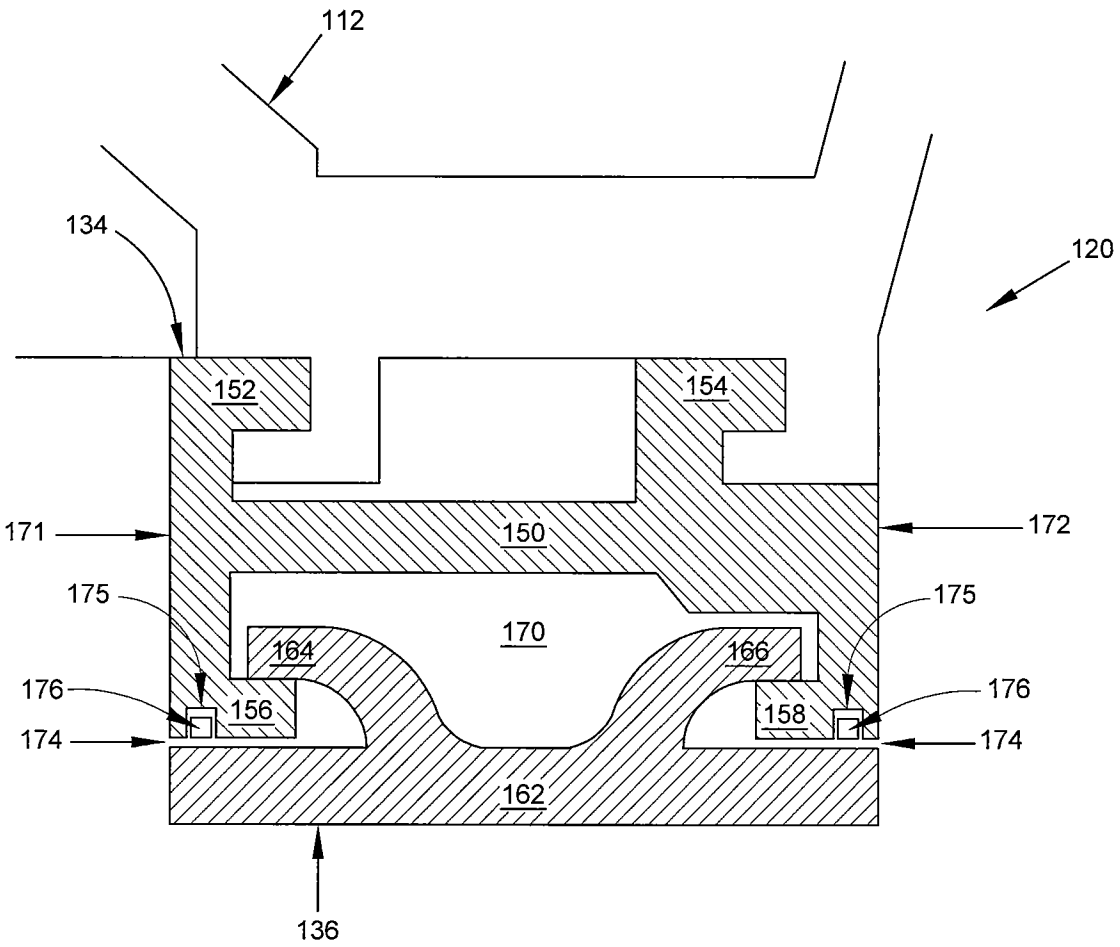
FIG. 4A is a detailed axial cross-sectional view of an alternative embodiment of a portion of FIG. 2 showing a shroud segment comprising a carrier segment and CMC seal segment.

As a first example, an embodiment is presented in FIGS. 3A, 3B, 3C, 3D, and 3E wherein a CMC seal segment 136 is carried by carrier segment 134 by at least one pin. FIG. 3A is a detailed axial cross-sectional view of a shroud segment 120 comprising a carrier segment 134 and CMC seal segment 136 having at least one pin bore flange 180 for pinning the CMC seal segment 136 to carrier segment 134. FIG. 3B is a detailed axial cross-sectional view of the mating region 174 of the shroud segment 120 of FIG. 3A. FIG. 3C is a radial cross-sectional view of the shroud segment 120 of FIG. 3A. FIG. 3D is a perspective view of CMC seal segment 136 having at least one pin bore flange 180. FIG. 3E is an axial cross-sectional view of the carrier segment 120 of FIG. 3A illustrating pressurized air conduits.

In this embodiment, carrier segment 134 comprises an axial flange 150 and one or more lateral flanges extending radially inward from the axial flange 150. In some embodiments, carrier segment 134 has a leading edge lateral flange 171, trailing edge lateral flange 172, first side lateral flange 168, and second side lateral flange 169. In other embodiments, carrier segment 134 comprises an axial flange 150 having a single, continuous lateral flange extending radially inward along the entire perimeter of axial flange 150. In some embodiments, carrier segment 134 is formed from high temperature nickel alloy.

The axial flange 150 extends axially along the axis 20 (which is the axis of the rotation of the turbine) and is adapted to engage the mount ring 112 and to support the CMC seal segments 136 as shown in FIG. 3A. In some embodiments, a leading edge mount bracket 152 and trailing edge mount bracket 154 extend radially outward from axial flange 150 to engage mount ring 112.

In some embodiments, leading edge lateral flange 171 defines a leading edge carrier bore 190 and trailing edge lateral flange 172 defines a trailing edge carrier bore 191. Each lateral flange 171, 172, 168, 169 has a radially inward-facing surface 173 (as shown in FIG. 3B) which defines a channel 175. In some embodiments, a compressible mating element 176, which may also be referred to as a sealing element, is disposed within the channel 175.

In one embodiment, a CMC seal segment 136 comprises an arcuate flange 162 and one or more pin bore flanges 180. The arcuate flange 162 extends around the blades 36 of the turbine wheel assembly 26 and blocks gasses from passing around the blades 36. Accordingly, the arcuate flanges 162 of each CMC seal segment 136 cooperate to define the outer edge of the flow path for air moving through the turbine 18.

As illustrated in FIG. 3D, arcuate flange 162 has an inward-facing surface 179 and outward-facing surface 182. Arcuate flange 162 additionally has a leading edge 192, trailing edge 195, a first axial edge 193, and second axial edge 194.

The one or more pin bore flanges 180 each define a segment bore 181 and extend outward in the radial direction from arcuate flange 162. In some embodiments, a pin bore flange 180 and spacing flange 183 are collectively referred to as a radial member. The CMC seal segment 136 illustrated in FIGS. 3A, 3B, 3C and 3D is carried by carrier segment 134 by an elongate pin (not shown) passed through the leading edge carrier bore 190, the segment bore 181, and the trailing edge carrier bore 191.

Figure 4B:
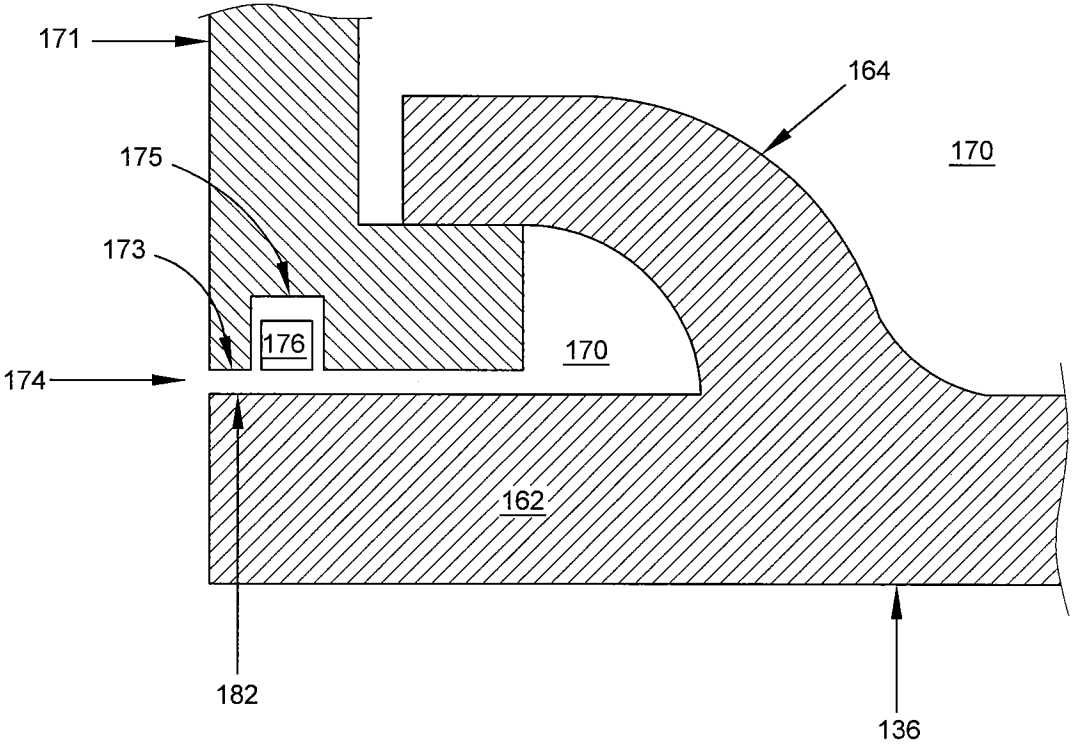
FIG. 4B is a detailed axial cross-sectional view of the mating region of the shroud segment of FIG. 4A.
Figure 4C:
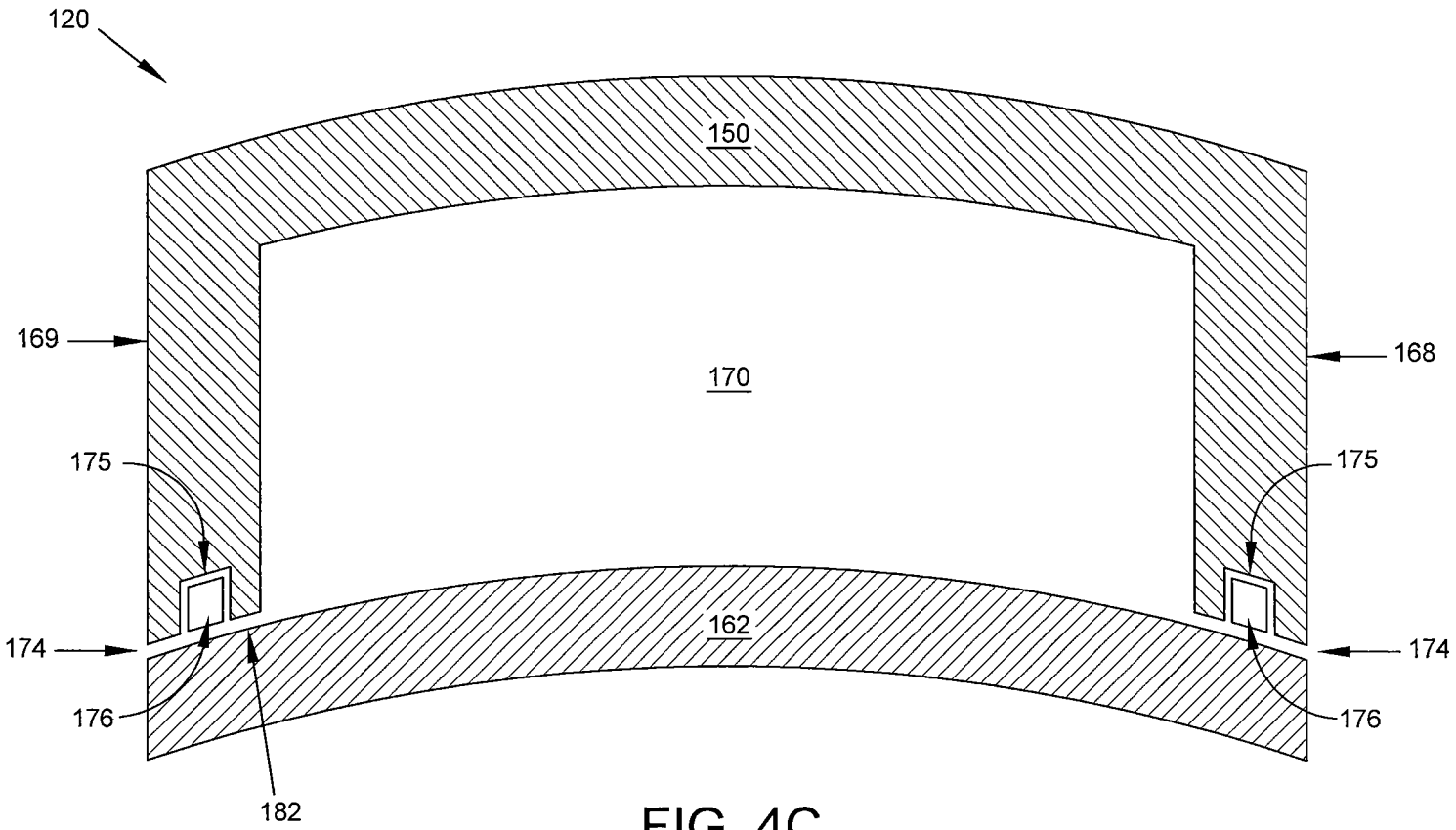
FIG. 4C is a radial cross-sectional view of the shroud segment of FIG. 4A.
Figure 4D:
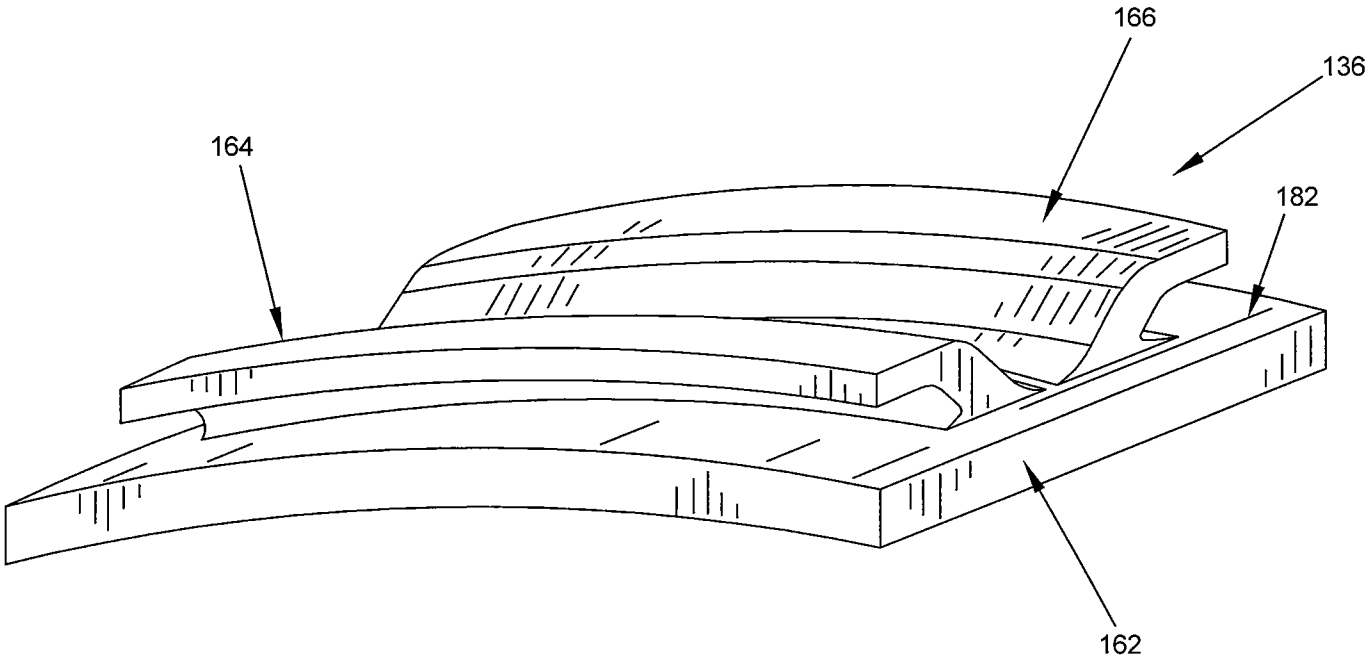
FIG. 4D is a perspective view of CMC seal segment having opposing hangar arms.
Figure 4E:
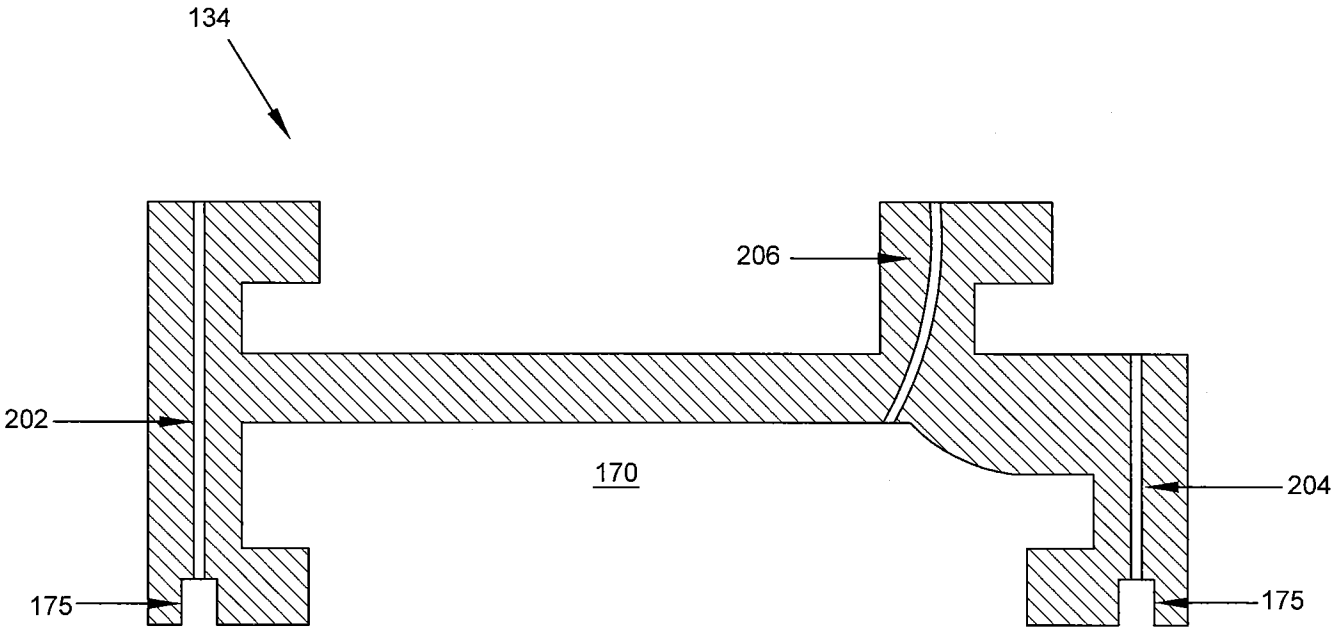
FIG. 4E is an axial cross-sectional view of the carrier segment shown in FIG. 4A illustrating pressurized air conduits.

As another example, an embodiment is presented wherein a CMC seal segment 136 is carried by carrier segment 134 by a forward hanger arm 164 and an aft hanger arm 166. FIG. 4A is a detailed axial cross-sectional view of a shroud segment 120 comprising a carrier segment 134 and CMC seal segment 136 having opposing hanger arms 164, 166. FIG. 4B is a detailed axial cross-sectional view of the mating region 174 of the shroud segment 120 of FIG. 4A. FIG. 4C is a radial cross-sectional view of the shroud segment 120 of FIG. 4A. FIG. 4D is a perspective view of CMC seal segment 136 having opposing hanger arms 164, 166. FIG. 4E is an axial cross-sectional view of the carrier segment 120 shown in FIG. 4A illustrating pressurized air conduits.

In some embodiments, leading edge lateral flange 171 includes a leading edge hanger bracket 156 and trailing edge lateral flange 172 includes a trailing edge hanger bracket 158 adapted to support CMC seal segment 136. Each lateral flange 171, 172, 168, 169 has a radially inward-facing surface 173 (as shown in FIG. 4B) which defines a channel 175. In some embodiments, a compressible mating element 176 is disposed within the channel 175.

As illustrated in FIGS. 4A through 4D, a CMC seal segment 136 illustratively includes an arcuate flange 162, a forward hanger arm 164 that extends outwardly in the radial direction from the arcuate flange 162, and an aft hanger arm 166 that extends outwardly in the radial direction from the arcuate flange 162. The arcuate flange 162 extends around the blades 36 of the turbine wheel assembly 26 and blocks gasses from passing around the blades 36. Accordingly, the arcuate flange 162 of each CMC seal segment 136 cooperate to define the outer edge of the flow path for air moving through the turbine 18.

The forward and the aft hanger arms 164, 166 support the arcuate flange 162 relative to a corresponding carrier segment 134. The forward hanger arm 164 is adapted to engage the leading edge hanger bracket 156 of carrier segment 134. The aft hanger arm 166 is adapted to engage the trailing edge hanger bracket 158 of carrier segment 134.

In other embodiments, the direction of the axial extension of one or both of the forward and the aft hanger arms 164, 166 may be reversed. In one example, the forward hanger arm 164 could extend rearward in the axial direction and the aft hanger arm 166 could also extend rearward. In another example, both the forward hanger arm 164 and the aft hanger arm 166 could extend forward in the axial direction.

The carrier segment 134 of the above embodiments is illustratively made from a metal alloy but in some embodiments may be made from a ceramic material, a composite material such as a CMC material, or another suitable material. The CMC seal segment 136 of each shroud segment 120 is illustratively a monolithic ceramic component made from ceramic-matrix-composite materials (CMCs) that are adapted to withstand high temperature environments. In other embodiments, the CMC seal segment 136 of each shroud segment 120 may be made from other materials.

The embodiments of FIGS. 3A and 4A present a mating region 174 formed proximate the entire perimeter of outward-facing surface 182 of the arcuate flange 162 of CMC seal segment 136. Further, when a shroud segment 120 is assembled, a cavity 170 is formed between the carrier segment 134 and the CMC seal segment 136 as shown in FIGS. 3A and 4A. The cavity 170 is bounded by the outward-facing surface 182 of the arcuate flange 162 of CMC seal segment 136 and axial flange 150 and one or more lateral flanges of carrier segment 134. In some embodiments, cavity 170 is bounded by outward-facing surface 182, axial flange 150, leading edge lateral flange 171, trailing edge lateral flange 172, first side lateral flange 168, and second side lateral flange 169.

FIGS. 3A through 3E and 4A through 4E present still further embodiments of a shroud segment 120 wherein pressurized air is supplied via a plurality of pressurized air conduits to one or more of the cavity 170 and channel 175 to provide buffering. In some embodiments, pressurized air is supplied from the compressor 14, and can be supplied from the various intermediate stages of the compressor 14 or from the discharge air of compressor 14 in order to provide varying pressures to one or more of the cavity 170 and channel 175. In the disclosed embodiments having pressurized air supplied via conduits to the channel 175 to provide buffering, mating region 174 is referred to as buffering region 207.

FIG. 3E illustrates a first conduit 202 disposed in the leading edge lateral flange 171 which is adapted to receive a first pressurized air. A second conduit 204 is disposed in the trailing edge lateral flange 172 and adapted to receive second pressurized air. Further, a third conduit 206 is disposed in axial flange 150 and adapted to receive third pressurized air. Similarly, FIG. 4E illustrates first conduit 202, second conduit 204, and third conduit 206. Conduits 202, 204, and 206 are formed integrally to carrier segment 134 as thin apertures adapted to receive pressurized air. First conduit 202 and second conduit 204 supply pressurized air to channel 175. Third conduit 206 supplies pressurized air to cavity 170.

In some embodiments, first pressurized air and second pressurized air supplied to first conduit 202 and second conduit 204, respectively are supplied from the same pressurized air supply such that channel 175 is buffered at an equal pressure throughout. For example, first pressurized air and second pressurized air can both be supplied from compressor 14 discharge air or from the pressurized air of the seventh stage of compressor 14, designated HP7. In other embodiments, first pressurized air is supplied from a different pressurized air supply than second pressurized air, such that channel 175 is buffered at an unequal pressure throughout. For example, first pressurized air can be supplied from compressor 14 discharge air while second pressurized air can be supplied from the pressurized air of the seventh stage of compressor 14, designated HP7. As another example, first pressurized air can be supplied from the pressurized air of the seventh stage of compressor 14, designated HP7, while second pressurized air can be supplied from the pressurized air of the third stage of compressor 14, designated HP3. Effective buffering can still be achieved while supplying different air pressures to the leading and trailing edge channels 175 because the flowpath pressure of the combustion products drops across the turbine blades 36.

In general, it is desirable to provide pressurized air to channel 175 at a higher pressure than the pressure of the combustion products passing over the blades 36, which is referred to as the flow path air pressure. Buffering channel 175 with air at a greater pressure than flow path air pressure aids in reducing leakage of flow path air from the flow path.

In some embodiments, first pressurized air and second pressurized air supplied to first conduit 202 and second conduit 204, respectively, are at a different pressure than third pressurized air supplied to third conduit 206 such that channel 175 and cavity 170 are buffered at different pressures. For example, first pressurized air and second pressurized air can be supplied from compressor 14 discharge air while third pressurized air is supplied from the pressurized air of the seventh stage of compressor 14, designated HP7. As another example, first pressurized air and second pressurized air can be supplied from the pressurized air of the seventh stage of compressor 14, designated HP7, while third pressurized air can be supplied from the pressurized air of the third stage of compressor 14, designated HP3. In some embodiments, the third air pressure is supplied at a pressure lower than the pressure of the flow path combustion products. In other embodiments, the third pressurized air may be supplied from the compressor discharge or an intermediate stage at a pressure higher than that supplied to the first or second pressurized air.

In other embodiments, first pressurized air, second pressurized air, supplied to first conduit 202 and second conduit 204, respectively, and third pressurized air supplied to third conduit 206 are supplied from the same pressurized air source or are supplied by pressurized air sources at the same pressure such that channel 175 and cavity 170 are buffered at equal pressures.

Figure 5B:
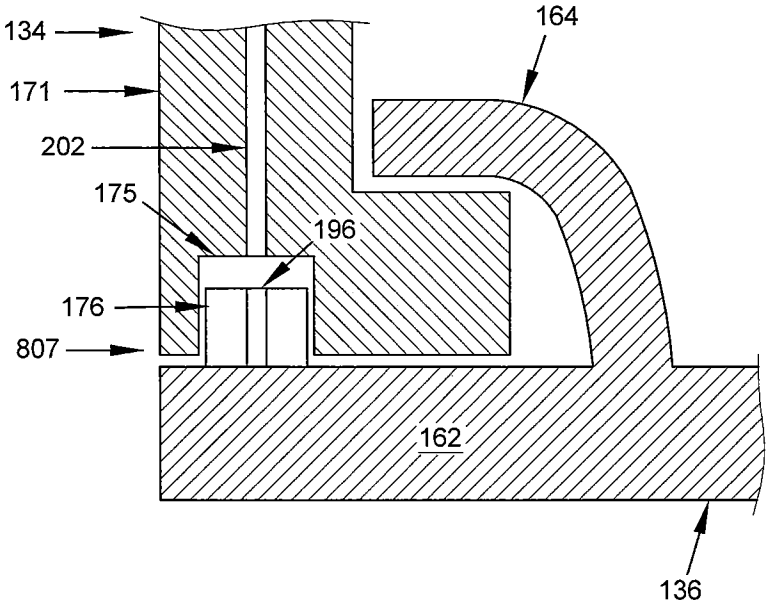
FIGS. 5A, 5B, 5C, and 5D are detailed axial cross-sectional views of the mating regions of shroud segments in accordance with various embodiments of the disclosure.
Figure 5A:
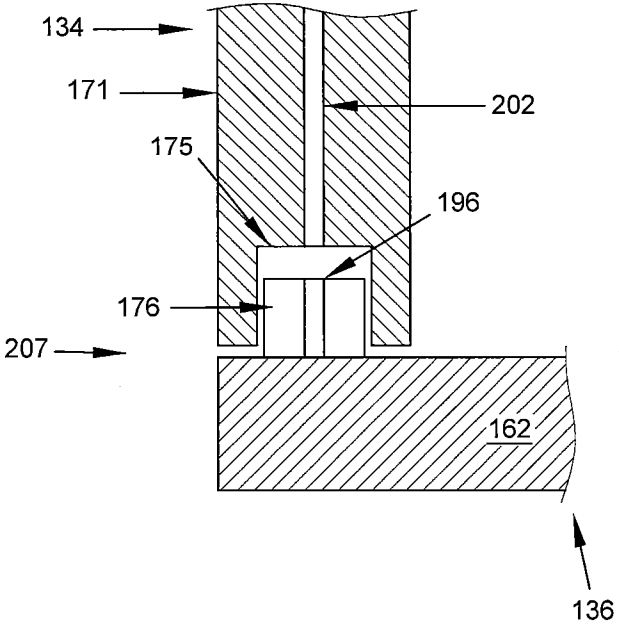
Figure 6:
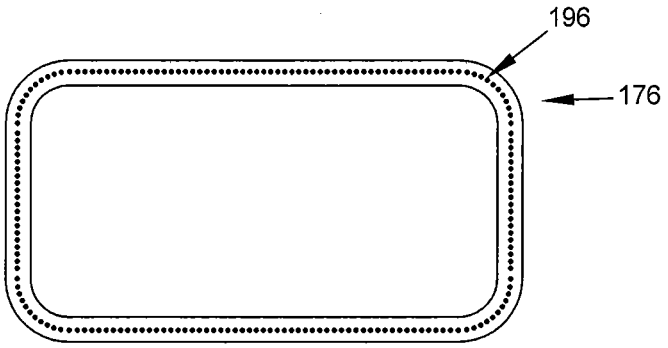
FIG. 6 is a plan view of a compressible mating element.

FIGS. 5A and 5B are detailed axial cross-sectional views of buffering region 207 having a compressible mating element 176 of a first type. In some embodiments, compressible mating element 176 is formed from mica board or similar gasket material. In some embodiments, as illustrated in FIG. 6, compressible mating element 176 is radially perforated, which is to say that compressible mating element 176 is an elongate element having a plurality of conduits 196 aligned radially and positioned along the length of compressible mating element 176. In still further embodiments, compressible mating element 176 is an omega seal. In some embodiments, compressible mating element 176 is a unitary element formed from a single piece of sealing material. In some embodiments, compressible mating element 176 is adapted to fill channel 175. In some embodiments, the compressible mating element 176 consist of two rows of J seals or rope seals.

Figure 5D:
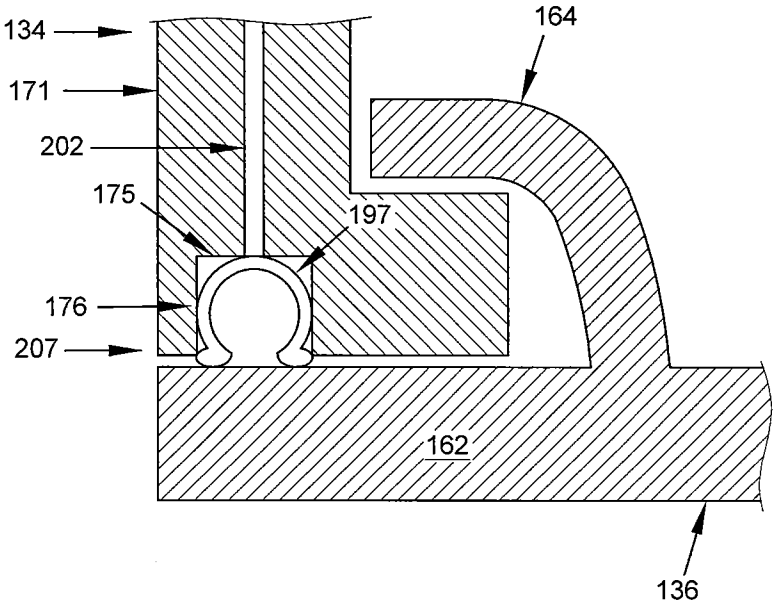
Figure 5C:
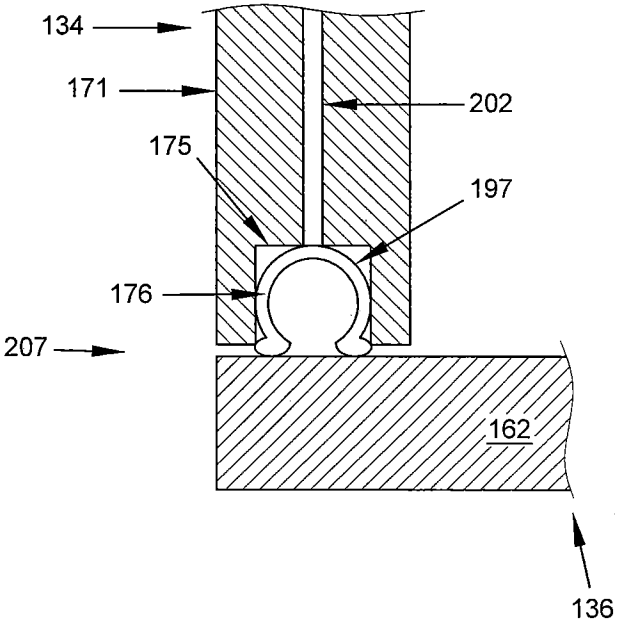

FIGS. 5C and 5D are detailed axial cross-sectional views of buffering region 207 having a compressible mating element 176 of a second type. More specifically, in FIGS. 5C and 5D the compressible mating element 176 is an omega seal 197 disposed within channel 175.

Figure 7A:
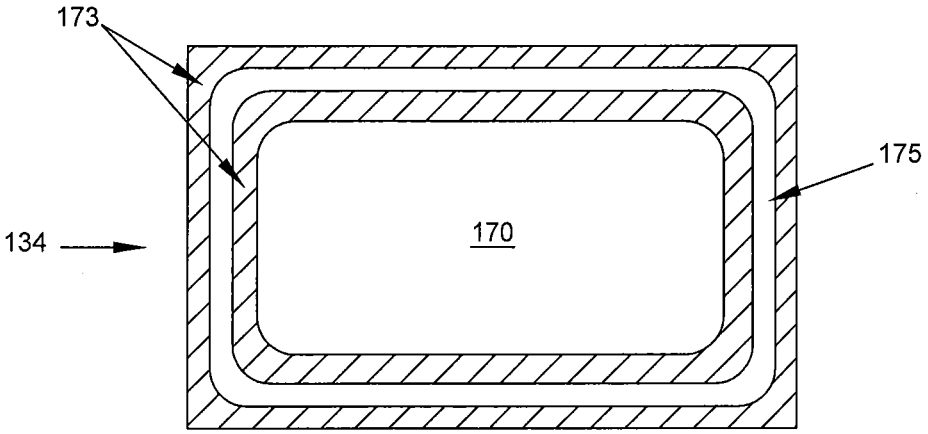
FIG. 7A is a radially outward-facing view of the radially inward-facing surface of a carrier segment.
Figure 8:
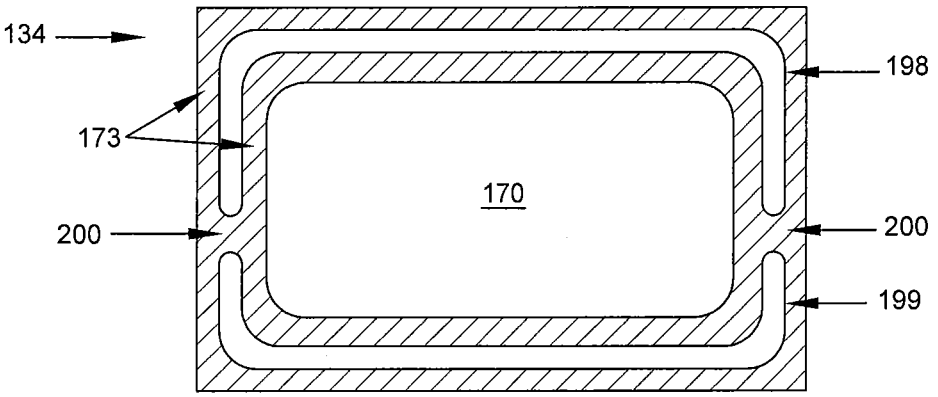
FIG. 8 is a radially outward-facing view of the radially inward-facing surface of a carrier segment.
Figure 7B:
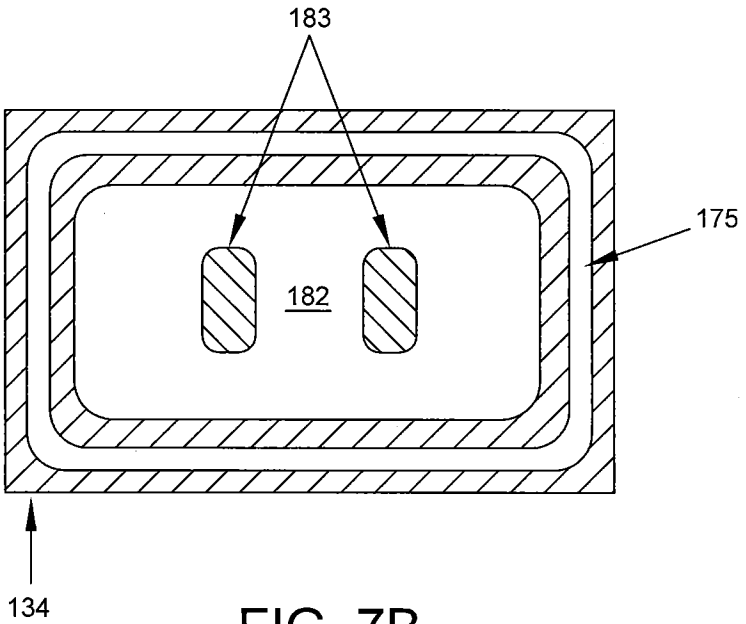
FIG. 7B is a radially inward-facing cross-sectional view of a mating region of a shroud segment.

FIG. 7A is a radially outward-facing view of the radially inward-facing surface 173 of a carrier segment 134. FIG. 7B is a radially inward-facing cross-sectional view of a mating region 174 of a shroud segment 120. In some embodiments, as illustrated in FIGS. 7A and 7B, channel 175 is a unitary channel formed along the entire inward-facing surface 173 of the one or more lateral flanges 171, 172 extending radially inward from the axial flange 150. However, in other embodiments such as illustrated in FIG. 8, channel 175 is divided into a first portion 198 and second portion 199 which are separated by one or more dividers 200. FIG. 8 is a radially outward-facing view of the radially inward-facing surface 173 of a carrier segment 134. In some embodiments, first portion 198 is disposed proximate the forward edge 192 of the CMC seal segment 136 and second portion 199 is proximate along the aft edge 195 of the CMC seal segment 136.

In some embodiments, a compressible mating element 176 is disposed in each of first portion 198 and second portion 199. In other embodiments, one or both of first portion 198 and second portion 199 do not contain a compressible mating element 176. With an unsealed second portion 199, cavity 170 is vented to the flow path.

In some buffered embodiments, first portion 198 and second portion 199 are supplied with pressurized air from the same pressurized air source, such that first portion 198 and second portion 199 are buffered at equal pressures. For example, first portion 198 and second portion 199 can both be supplied with pressurized air from compressor 14 discharge air or from the pressurized air of the seventh stage of compressor 14, designated HP7. In other buffered embodiments, first portion 198 and second portion 199 are supplied with pressurized air from different pressurized air sources such that first portion 198 and second portion 199 are buffered at unequal pressures. For example, first portion 198 can be supplied with pressurized air from compressor 14 discharge air while second portion 199 can be supplied with pressurized air from the seventh stage of compressor 14, designated HP7. As another example, first portion 198 can be supplied with pressurized air from the seventh stage of compressor 14, designated HP7, while second portion 199 can be supplied with pressurized air from the third stage of compressor 14, designated HP3. Where second portion 199 is supplied with pressurized air at a lower pressure than cavity 170, cavity 170 is vented through the second portion 199 to the flow path. In some embodiments, the cavity 170 is vented to the trailing edge of the second portion through an additional channel or conduit (not shown) in the aft lateral flange 172. This embodiment may also be utilized when the channel 175 is not divided into a first and second portion 198, 199.

In further embodiments, first portion 198 is supplied with a first pressurized air while second portion 199 is not supplied with pressurized air. With an unbuffered second portion 199, cavity 170 is vented to the flow path. In some embodiments, the cavity 170 is vented to the trailing edge of the second portion through an additional channel or conduit (not shown) in the aft lateral flange 172. This embodiment may also be utilized when the channel 175 is not divided into a first and second portion 198, 199.

In still further embodiments, first portion 198 and cavity 170 are supplied with pressurized air at the same pressure while second portion 199 is supplied with pressurized air at a lower pressure. For example, first portion 198 and cavity 170 are supplied with discharge air of compressor 14 while second portion 199 is supplied with the pressurized air of the seventh stage of compressor 14, designated HP7. In such an embodiment, cavity 170 is vented through the second portion 199 to the flow path. In some embodiments, the cavity 170 is vented to the trailing edge of the second portion through an additional channel or conduit (not shown) in the aft lateral flange 172. This embodiment may also be utilized when the channel 175 is not divided into a first and second portion 198, 199.

In some embodiments it is desirable to supply pressurized air to channel 175 at a higher pressure than the pressurized air supplied to the cavity 170 in order to prevent leakage from the flow path into the cavity 170.

Traditional designs of cartridge-style CMC seal segments 136 and carrier segments 134 require discharge air from the compressor 14 be supplied to the cavity 170 or to the outer-facing surface 182 of the CMC seal segment 136. This air is supplied both to cool the CMC seal segment 136 and to prevent leakage from the flow path in a radial direction past the CMC seal segment 136. However, supplying discharge air from the compressor 14 creates a high pressure load across the CMC seal segment 136 in the radial direction. By allowing the pressurized air supplied to the cavity 170 to be at a lower pressure than the pressure of discharge air from the compressor 14, the disclosed embodiments of a shroud segment 120 with a mating region 174 or buffering region 207 reduce pressure loads in the radial direction across the arcuate flange 162 of the CMC seal segment 136 resulting in longer lifespans for components. While the pressurized air supplied to the cavity 170 may be at a higher pressure than the trailing-edge flow path pressure such that cooling or purge air will vent to the flowpath, this supplied air pressure may be sufficiently low to allow a negative pressure gradient over the forward portion of the CMC seal segment 136 where the flow path air pressure is highest. When the pressures are balanced correctly, the net load between the CMC seal segment 136 and carrier segment 134 can be shifted from tension to compression by using a lower air pressure supplied to the cavity 170 than that used by traditional sealing segments. Traditional sealing segments do not use perimeter seals and therefore require higher air pressures to prevent flowpath air leakage.

The disclosed embodiments further achieve a work savings, since diverting air from an intermediate stage of the compressor 14 requires less work by the gas turbine engine than diverting discharge air of the compressor 14. Air from an intermediate stage is at a lower pressure and a lower temperature than discharge air, so that supplying air to the cavity 170 from an intermediate stage also has a greater cooling effect on the CMC seal segment 136. Less air is required to achieve the same cooling effect when air from an intermediate stage is used in favor of discharge air.

The shroud segment 120 embodiments disclosed herein additionally provide an ease of handling, assembly, and installation not available in the prior art. For example, operations such as match fitting or shimming, which are conducted to set the clearance between blades 36 of turbine wheel assembly 26 and the CMC seal segment 136, can be performed by altering a metal alloy carrier segment 134 instead of a CMC seal segment 136. This advantage will reduce or eliminate the machining of the CMC seal segment 136, which reduces assembly and installation costs and avoids damaging the CMC structure which can reduce CMC seal segment lifespan.

Figure 9:
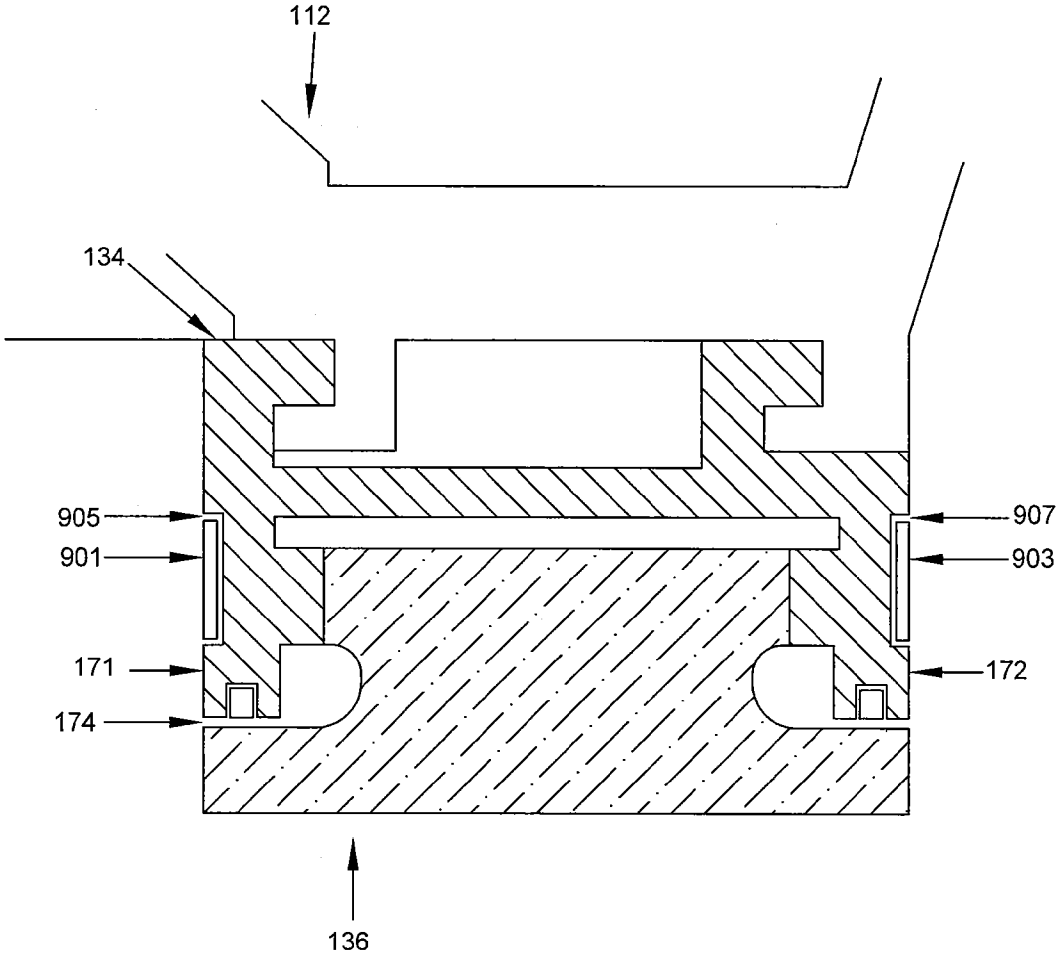
FIG. 9 is an axial cross-sectional view of a shroud segment having a static seal.
Figure 10:
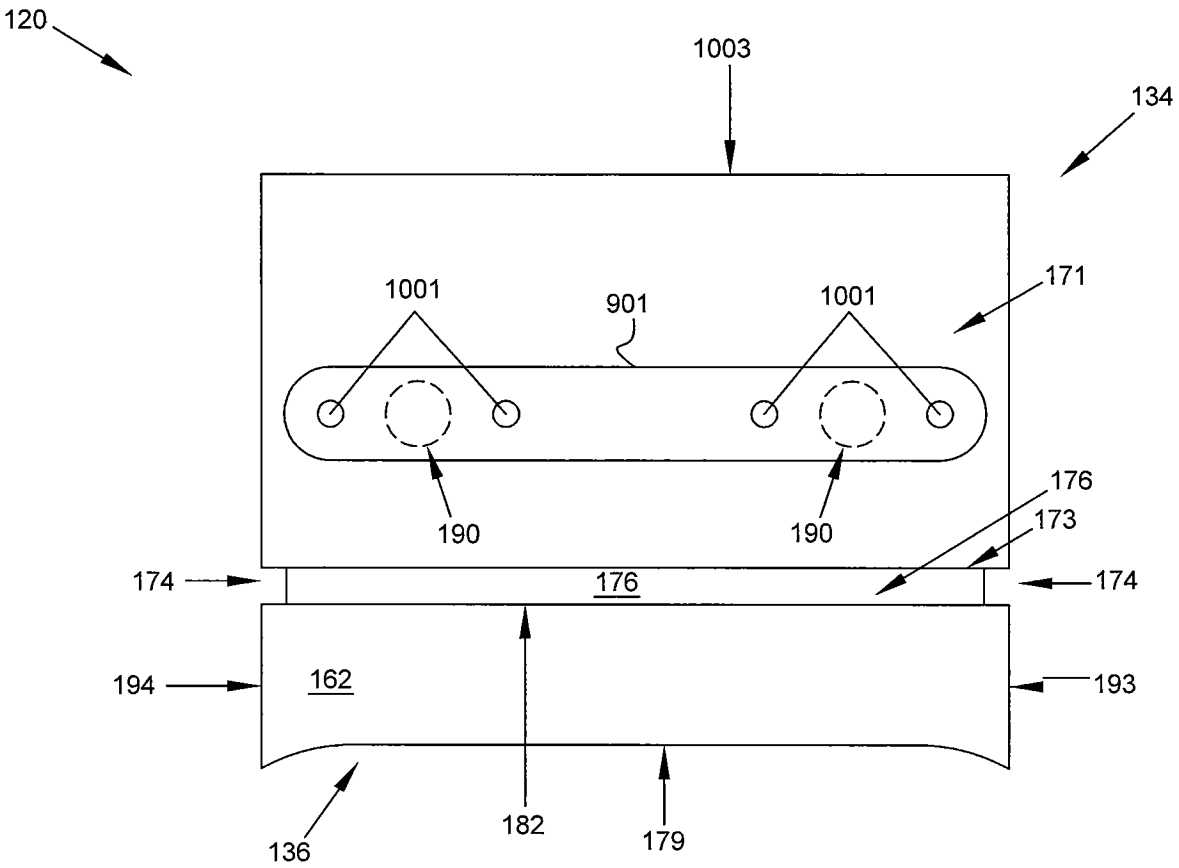
FIG. 10 is a radial profile view of the leading edge lateral flange of a shroud segment with a static seal.

In some embodiments, the carrier segment 134 includes a static seal cover 901, 903 on the forward and aft lateral flanges 171, 172 proximate to the forward carrier bore 190 and aft carrier bore 191 as shown in FIG. 9. This static seal may comprise 3M Mat Mount, mica board, ceramic rope seal, metal or other suitable material and is used to seal any clearances within the cavity 170 between the bores of the carrier segment 134 and CMC seal segment 136 to prevent the flow of air into or out of the cavity 170. Sealing the forward and aft carrier bores 190, 191 prevents the loss of any cooling air supplied via cavity conduit 206. In addition, the static seal prevents any flow path air, which may have leaked by any inter-segment seal, from pressurizing the cavity 170 and thereby subjecting the outward-facing surface 182 of the arcuate flange 162 of the CMC seal segment 136 to higher pressure loads and temperatures. These static seals 901, 903 may fully cover the forward and aft carrier bores 190, 191 and be secured to the carrier segment 134 using separate capscrews 1001, as shown in FIG. 10, or other retaining method. As shown in FIG. 9, lateral flanges 171 and 172 may be machined to provide a slot 905, 907 adapted to receive the static seals 901, 903, allowing the static seals to be mounted flush with the outer, forward facing and outer, reward facing surfaces of lateral flanges 171, 172, respectively. Alternatively, the lateral flanges 171, 172 may not be machined, or machined such that the static seals 901, 903 are not flushly mounted. In some embodiments, the elongated pin retaining the CMC seal segment 136 also passes through and is used to secure the static seal to the lateral flanges 171, 172. In such an embodiment, the elongated pin may be hollow to accommodate a capscrew passing from the forward to aft lateral flanges. This arrangement provides for a uniform pressure applied to the static seal around the forward and aft carrier bore 190, 191 which enhances the sealing properties as well as providing a redundant means for securing the CMC seal segment 136 to the carrier segment 134 if the elongated pin were to fail. In addition to providing a seal, the static seal cover also functions to retain the elongated pins. In some embodiments, a static seal cover can be provided on both the inner and outer surfaces of the lateral flanges 171, 172.

The inward and outward facing surfaces 179, 182 of the arcuate flange 162, the inward facing surface 173 of the lateral flange 171, and the radially outward facing surface 1003 of the carrier segment 134 are shown as having generally parallel curves. In some embodiments, one or more of these surfaces may be machined with straight and orthogonal or other surface shapes.

Inter-segment seals may be used between shroud segments 120 to prevent leakage of flow path air between shroud segments. Inter-segment seals comprise strip seals or other suitable sealing means and are arranged circumferentially between shroud segments 120. In some embodiments, strip seals are located in slots machined into the carrier segment 134. Placing the inter-segment seals between adjacent carrier segments 134 allows for metal-to-metal sealing and avoids machining the CMC seal segment 136 in addition to the thermal stresses which would result from the different thermal expansion rates between the CMC seal segment and any inter-segment sealing element.

Figure 11:
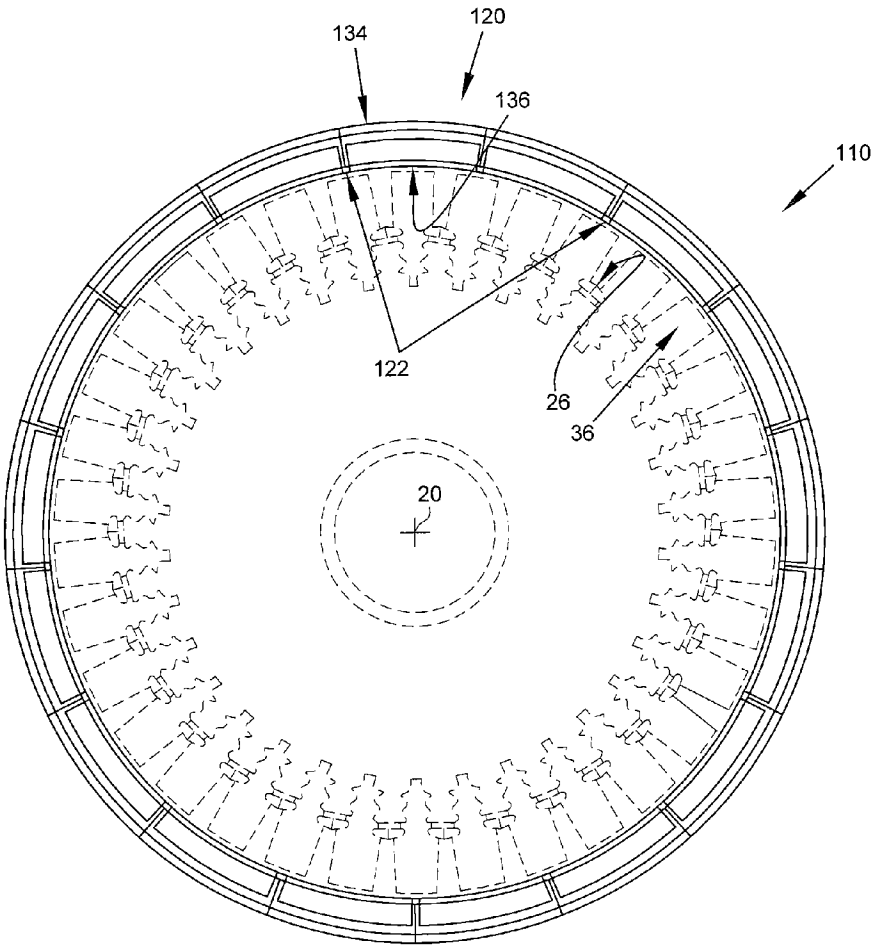
FIG. 11 is a rear elevation view of the turbine shroud showing inter-segment seals.
Figure 12:
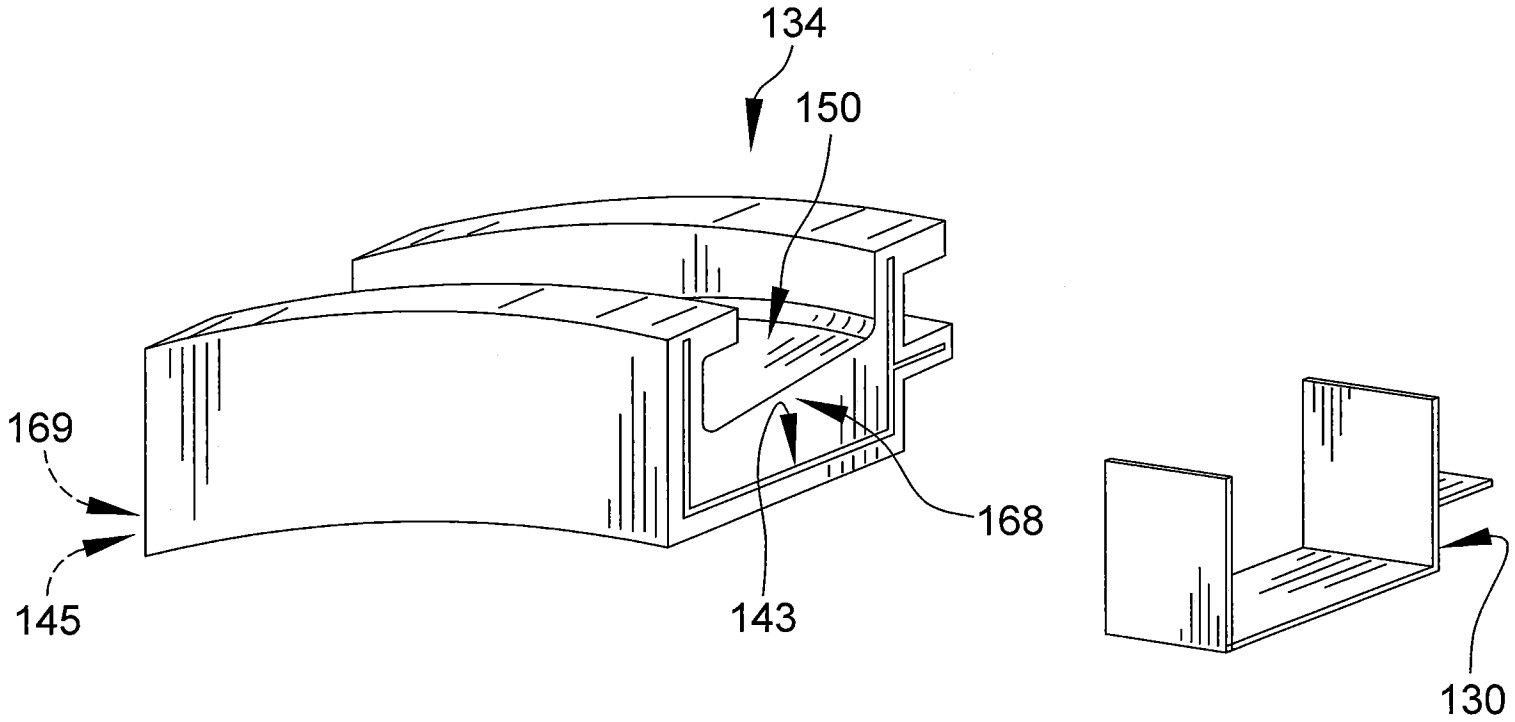
FIG. 12 is an exploded perspective view of the carrier segment and inter-segment seal.

The plurality of shroud segments 120 are illustratively assemblies that are arranged circumferentially adjacent to one another to form a ring around the turbine wheel assembly 26 as shown, for example, in FIG. 11. Circumferential seals 130 are illustratively strip seals arranged circumferentially between the shroud segments 120 to block gasses from passing through a circumferential interface 122 between shroud segments 120 as shown in FIGS. 11 and 12. The strip seals 130 are illustratively located in slots 143, 145 formed in axial oriented lateral flanges of the relatively cool carrier segments 134 that hold relatively hot CMC seal segments 136 included in each shroud segment 120 such that locating slots need not be formed in the CMC seal segments 136.

The circumferential seal 130 may be located by inserting the circumferential seal 130 (illustratively a strip seal) into the seal-locating features 143, 145 (illustratively seal-receiving slots) formed in the carrier segments 134. In some embodiments, the circumferential seal 130 may be a plurality of small strip seals that are each inserted into the seal-locating features 143, 145 formed in the lateral flanges 168, 169 of carrier segments 134.

In some embodiments, the shroud segments 120 has metal to metal chordal seals between the nozzle guide vanes (not shown) and the carrier segment 134. While multiple forms of sealing techniques may be used, the carrier segment 134 with lateral flange 171 allows sealing the leading edge of the shroud segment 120 without requiring machining the CMC segment 136.

In some embodiments, the trailing edge of the shroud segment 120 is sealed to the aft vane with "W" or an omega seal. Specifically, this seal is connected to the aft face of the aft lateral flange 172 of the carrier segment 134. Alternative forms of seals can be used in this location with is subjected to lower pressures and temperatures than the leading face of the forward lateral flange 171.

Axial loads from the nozzle guide vanes are transferred to the carrier segment 134. Gussets or angled surfaces inside the carrier segment 134 may be used to transfer this load to the carrier hangers, such as hanger 152. In this arrangement, the carrier segment 134 isolates the CMC seal segment 136 from the axial loads transferred through the mating components and fore and aft seals.

Pinned CMC Seal Segment

Another embodiment of the present disclosure is directed to a system and method for reducing stresses caused by attaching the CMC seal segment to a carrier segment by providing a CMC seal segment with elongate pin bores.

Figure 13:
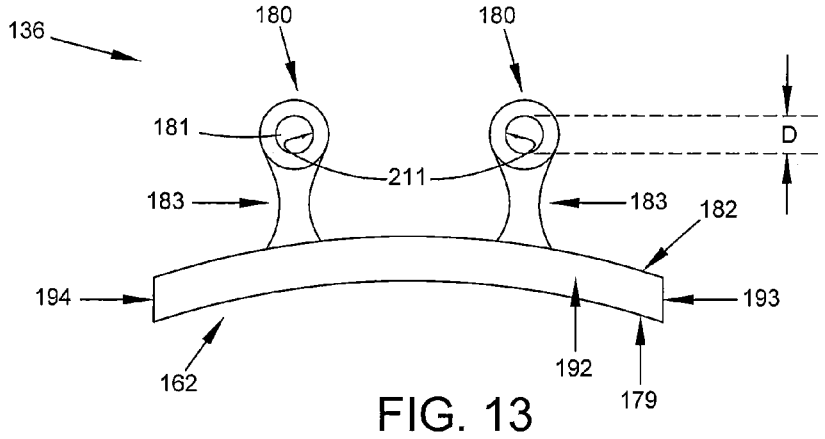
FIG. 13 is a profile view of the forward edge of a CMC seal segment in accordance with some embodiments.
Figure 14:
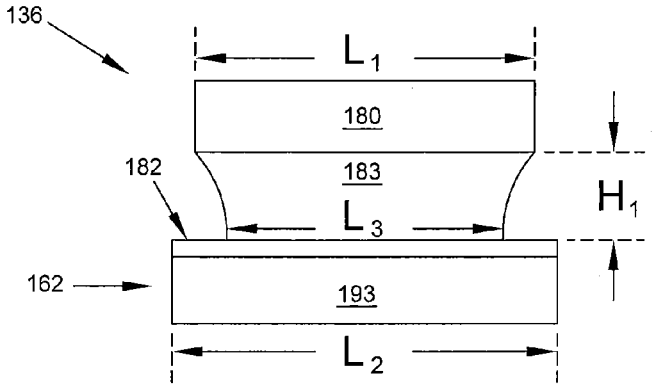
FIG. 14 is a profile view of the first axial edge of a CMC seal segment in accordance with some embodiments.
Figure 15:
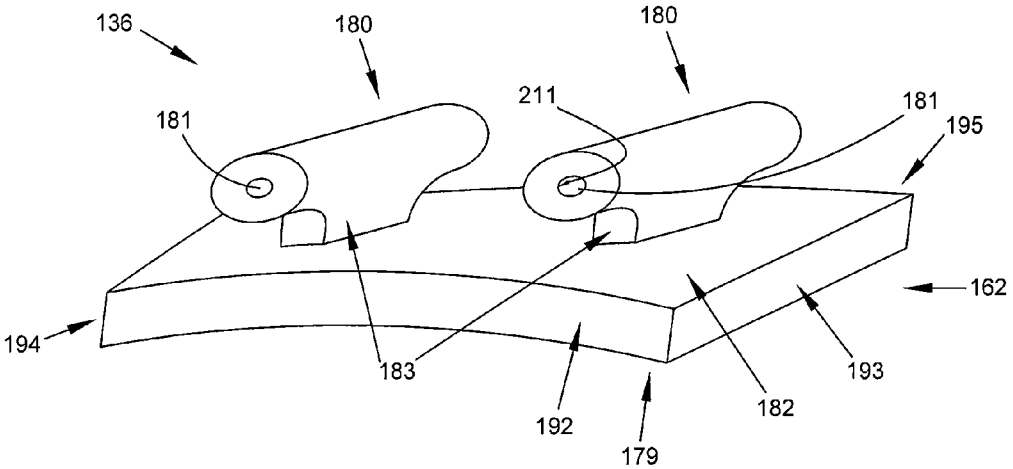
FIG. 15 is a perspective view of the CMC seal segment illustrated in FIGS. 13 and 14 in accordance with some embodiments.

FIG. 13 is a profile view of the leading edge 192 of a CMC seal segment 136 in accordance with some embodiments. FIG. 14 is a profile view of the first axial edge 193 of a CMC seal segment 136 in accordance with some embodiments. FIG. 15 is a perspective view of the CMC seal segment 136 illustrated in FIGS. 13 and 14.

Similar to the CMC seal segment 136 presented in FIGS. 3A and 3B above, the CMC seal segment 136 of FIGS. 13, 14, and 15 comprises an arcuate flange 162 and one or more pin bore flanges 180. Each of the one or more pin bore flanges 180 is connected to the arcuate flange 162 by a spacing flange 183. The spacing flange 183 is used to radially space the pin bore flange 180 away from the arcuate flange 162. A pin bore flange 180 may also be referred to as a radial member.

A series of arcuate flanges 162 extends circumferentially around the blades 36 of the turbine wheel assembly 26 and blocks gasses from passing around the blades 36 without impinging on the blades 36. Accordingly, the arcuate flange 162 of each CMC seal segment 136 cooperate to define the outer edge of the flow path for air moving through the turbine 18.

Arcuate flange has a leading edge 192, which may also be referred to as the forward edge, and a trailing edge 195, which may also be referred to as the aft edge. In some embodiments, the forward edge 192 and aft edge 195 are substantially perpendicular to the turbine axis 20. Arcuate flange 162 further has a first axial edge 193 and second axial edge 194 which, in some embodiments, are substantially parallel to the turbine axis 20. Further, arcuate flange 162 has an inward-facing surface 179 which is a curved surface facing the turbine blades 36 and an outward-facing surface 182 facing away from the turbine blades 36.

The one or more pin bore flanges 180 each define an elongate segment bore 181 adapted to receive an elongated pin 210. Various geometries of the inner surface 211 of segment bore 181 are contemplated. In some embodiments, segment bore 181 has a lateral cross-section with a continuously curved outer edge, meaning the inner surface 211 of segment bore 181 is continuously curved. In some embodiments, segment bore 181 has a lateral cross-section with a circular outer edge, meaning the inner surface 211 of segment bore 181 is circular and defines a cylindrical bore.

Segment bore 181 is envisioned with a larger lateral cross-section dimension, labeled D on FIG. 13, than is provided for in the prior art through-thickness bores. The prior art through-thickness bores are manufactured by machining a bore through the wall thickness of a u-shaped seal segment and may also be referred to as edge-thickness or through-thickness bores. Various sizes of the lateral cross-sectional dimension are contemplated. In some embodiments, segment bore 181 has a lateral cross-sectional dimension D of at least three-eighths inches. In some embodiments, segment bore 181 has a lateral cross-sectional dimension D of at least one half inch. In some embodiments, segment bore 181 has a lateral cross-sectional dimension D of at least five-eighths inches.

Figure 18:
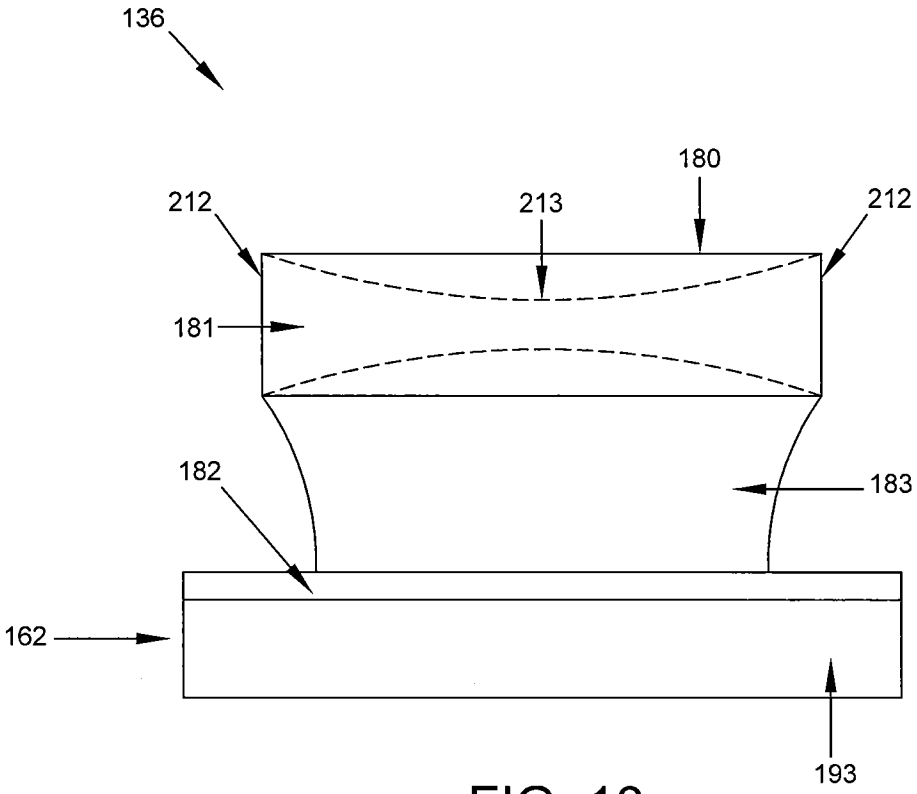
FIGS. 18 and 19 are axial profile views of the first axial edge of a CMC seal segment showing variations in the axial profile of a segment bore.
Figure 19:
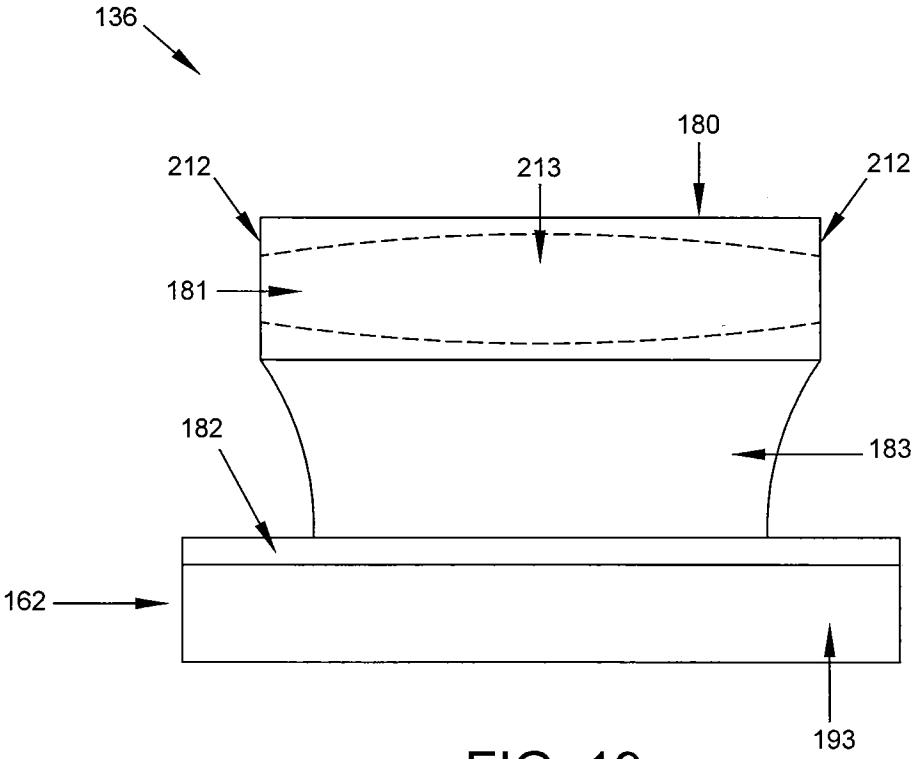

In some embodiments, the lateral cross-sectional dimension D of segment bore 181 varies along the length $L_1$ of the segment bore 181. FIGS. 18 and 19 are axial profile views of the first axial edge 193 of a CMC seal segment 136 showing variations in the axial profile of segment bore 181 in accordance with some embodiments. FIGS. 18 and 19 illustrate a CMC seal segment 136 with an arcuate flange 162 which is radially curved, such that outward-facing surface 182 is visible above first axial edge 193.

In FIG. 18, segment bore 181 tapers from either opposing ends 212 to the longitudinal center 213, resulting in a segment bore 181 which is narrowest at the longitudinal center 213. Thus, in some embodiments a minimum lateral cross-sectional dimension D of at least three-eighths inches, one half inch, five-eighths inches, or greater is measured at longitudinal center 213. In further embodiments, a maximum lateral cross-sectional dimension D of at least three-eighths inches, one half inch, five-eighths inches, or greater is measured at one or more of opposing ends 212.

In FIG. 19, segment bore 181 expands from either opposing end 212 to the longitudinal center 213, resulting in a segment bore 181 which is narrowest proximate either opposing end 212 and widest proximate the longitudinal center 213. Thus, in some embodiments a minimum lateral cross-sectional dimension D of at least three-eighths inches, one half inch, five-eighths inches, or greater is measured at one or more of opposing ends 212. In further embodiments, a maximum lateral cross-sectional dimension D of at least three-eighths inches, one half inch, five-eighths inches, or greater is measured at longitudinal center 213.

Pin bore flanges 180 are connected to outward-facing surface 182 of arcuate flange 162 by spacing flanges 183. Each spacing flange 183 extends radially outward from arcuate flange 162 to effect receipt of an elongated pin 210 within the segment bore 181. The height $H_1$ of each spacing flange 183 is determined to ensure alignment with associated bores of a carrier segment 134 as described further below in reference to FIGS. 16 and 17. In some embodiments, the spacing flanges 183 are absent and the pin bore flanges 180 are connected directly to the outward-facing surface 182 of the arcuate flange 162 of CMC seal segment 136.

In some embodiments, spacing flange 183 tapers from pin bore flange 180 to arcuate flange 162 such that the length $L_3$ of spacing flange 183 is less than the length $L_1$ of pin bore flange 180. In other embodiments, spacing flange 183 is flush with pin bore flange 180 such that the length $L_3$ of spacing flange 183 is equal to the length $L_1$ of pin bore flange 180. Further, in some embodiments the length $L_1$ of the pin bore flange 180 is equal to the length $L_2$ of the arcuate flange 162, whereas in other embodiments the length $L_1$ of the pin bore flange 180 is less than the length $L_2$ of the arcuate flange 162. In some embodiments the length $L_3$ of the spacing flange 183 and the length $L_1$ of the pin bore flange is equal to the length of the arcuate flange 162.

Figure 16:
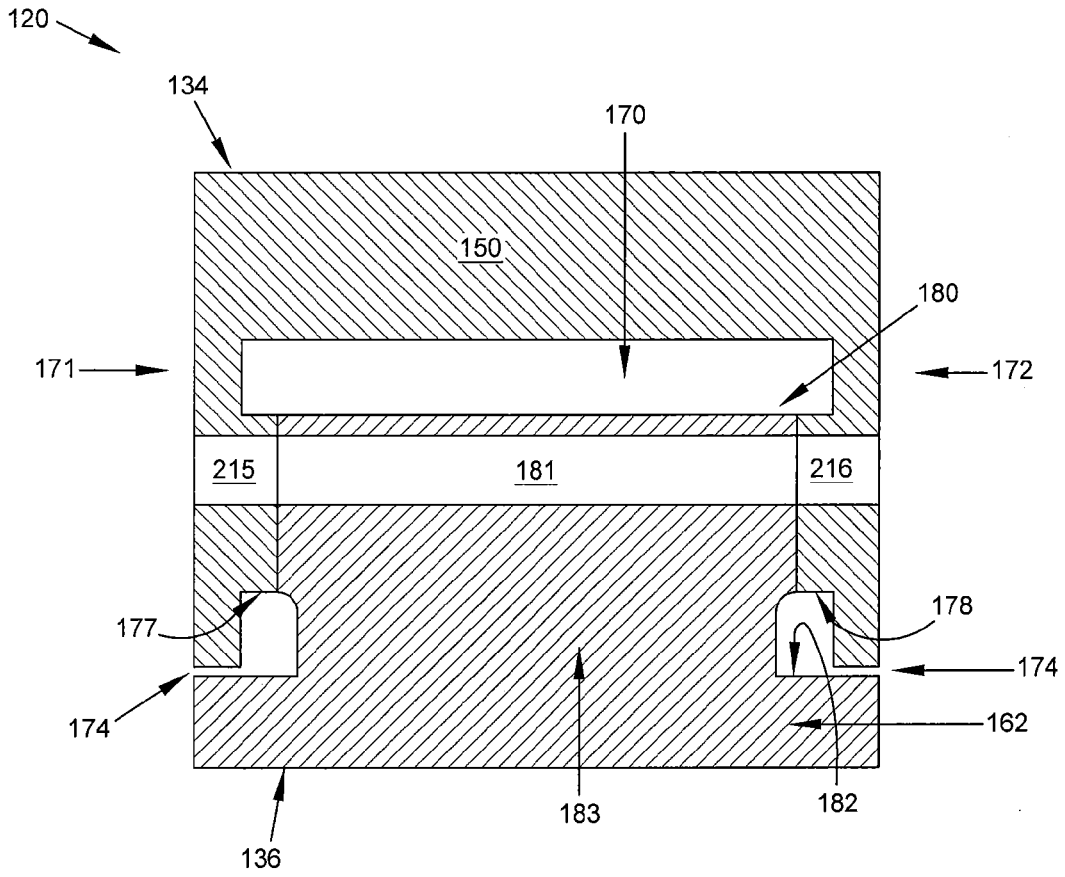
FIGS. 16 and 17 are axial cross-sectional views of a CMC seal segment aligned with a carrier segment.
Figure 17:
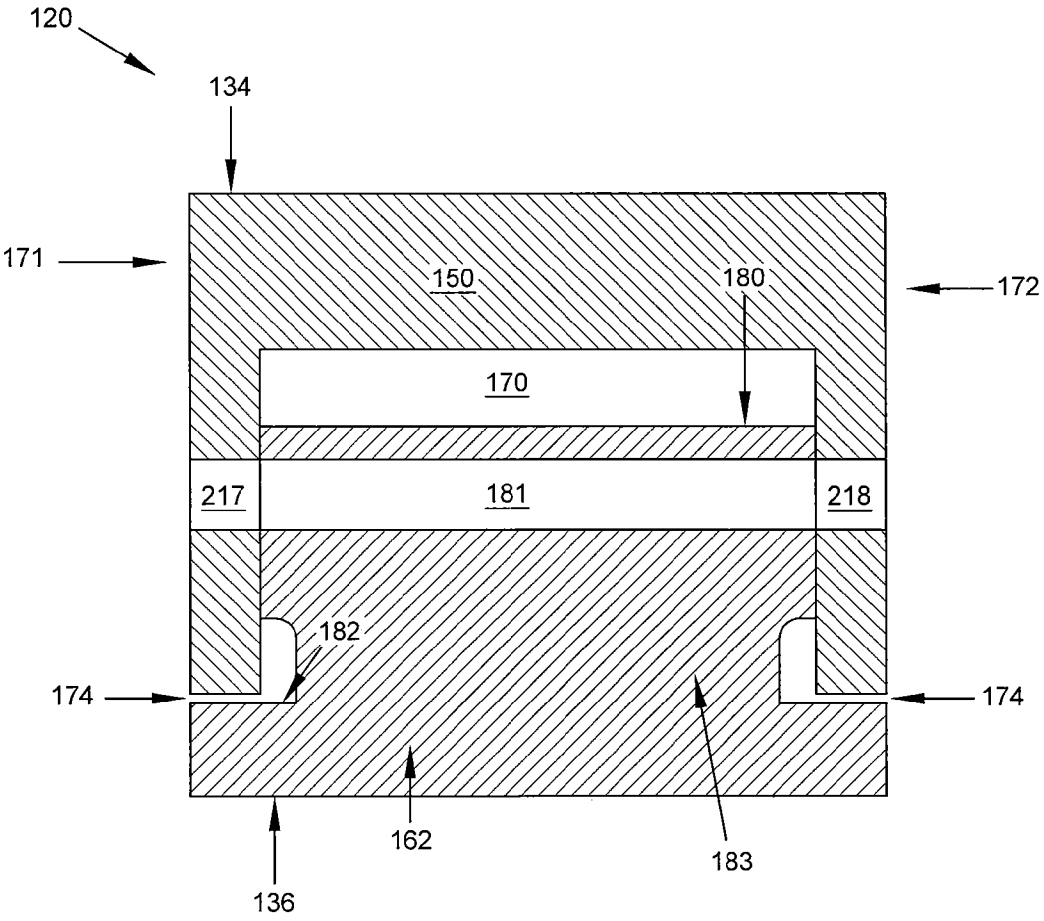

The CMC seal segment 136 illustrated in FIGS. 13, 14, and 15 is carried by carrier segment 134 by an elongated pin 210 which is passed through seal segment bore 181 and corresponding opposing bores on the carrier segment 134. A CMC seal segment 136 connected to a carrier segment 134 by an elongated pin 210 forms a shroud segment or cartridge 120. FIGS. 16 and 17 are side profile views of a CMC seal segment 136 aligned with a carrier segment 134 in accordance with some embodiments. More specifically, FIG. 16 is an axial cross-sectional view of a CMC seal segment 136 aligned with a carrier segment 134 having opposing cantilevered bores 215 while FIG. 17 is an axial cross-sectional view of a CMC seal segment 136 aligned with a carrier segment 134 having opposing through-thickness bores.

Similar to the shroud segment 120 presented in FIG. 3A, a carrier segment 134 is illustrated having an axial flange 150 and one or more lateral flanges 171, 172 extending radially inward from the axial flange 150. Forward lateral flange 171 includes a member 177 extending aft axially from the forward lateral flange 171 to define a forward cantilevered bore 215 having a length greater than the axial dimension of the forward lateral flange 171. Aft lateral flange 172 includes a member 178 extending axially forward from the aft lateral flange 172 to define an aft cantilevered bore 216 having a length greater than the axial dimension of the aft lateral flange 172. Axial flange 150, forward lateral flange 171, aft lateral flange 172, and arcuate flange 162 together define a cavity 170.

CMC seal segment 136 is positioned in cavity 170 such that segment bore 181 aligns with forward cantilevered bore 215 and aft cantilevered bore 216. Thus an elongated pin 210 can be passed through forward cantilevered bore 215, segment bore 181, and aft cantilevered bore 216 to connect CMC seal segment 136 to carrier segment 134. A mating region 174 is defined proximate the entire perimeter of outward-facing surface 182 of the arcuate flange 162 of CMC seal segment 136.

FIG. 17 presents a CMC seal segment 136 aligned with a carrier segment 134 having opposing through-thickness bores 217, 218. Similar to the shroud segment 120 presented in FIG. 16, a carrier segment 134 is illustrated having an axial flange 150 and one or more lateral flanges 171, 172 extending radially inward from the axial flange 150. Forward lateral flange 171 defines a forward through-thickness bore 217. Aft lateral flange 172 defines an aft through-thickness bore 218. Axial flange 150, forward lateral flange 171, aft lateral flange 172, and arcuate flange 162 together define a cavity 170. In some embodiments cantilevered bores are preferred to through-thickness bores 217, 218 as cantilevered bores provide reduced pin deflection, edge loading, and vertical stresses when compared to through-thickness bores.

CMC seal segment 136 is positioned in cavity 170 such that segment bore 181 aligns with forward through-thickness bore 217 and aft through-thickness bore 218. Thus an elongated pin 210 can be passed through forward through-thickness bore 217, segment bore 181, and aft through-thickness bore 218 to connect CMC seal segment 136 to carrier segment 134. A mating region 174 is defined proximate the entire perimeter of outward-facing surface 182 of the arcuate flange 162 of CMC seal segment 136.

Figure 20:
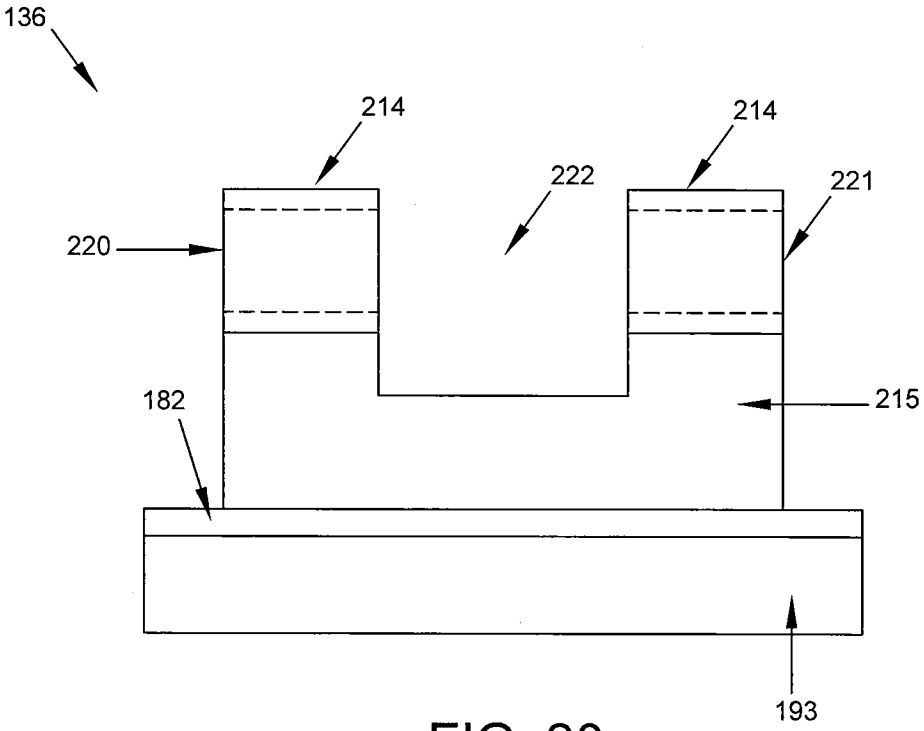
FIG. 20 is an axial profile view of the first axial edge of a CMC seal segment having a segmented pin bore flange.
Figure 21:
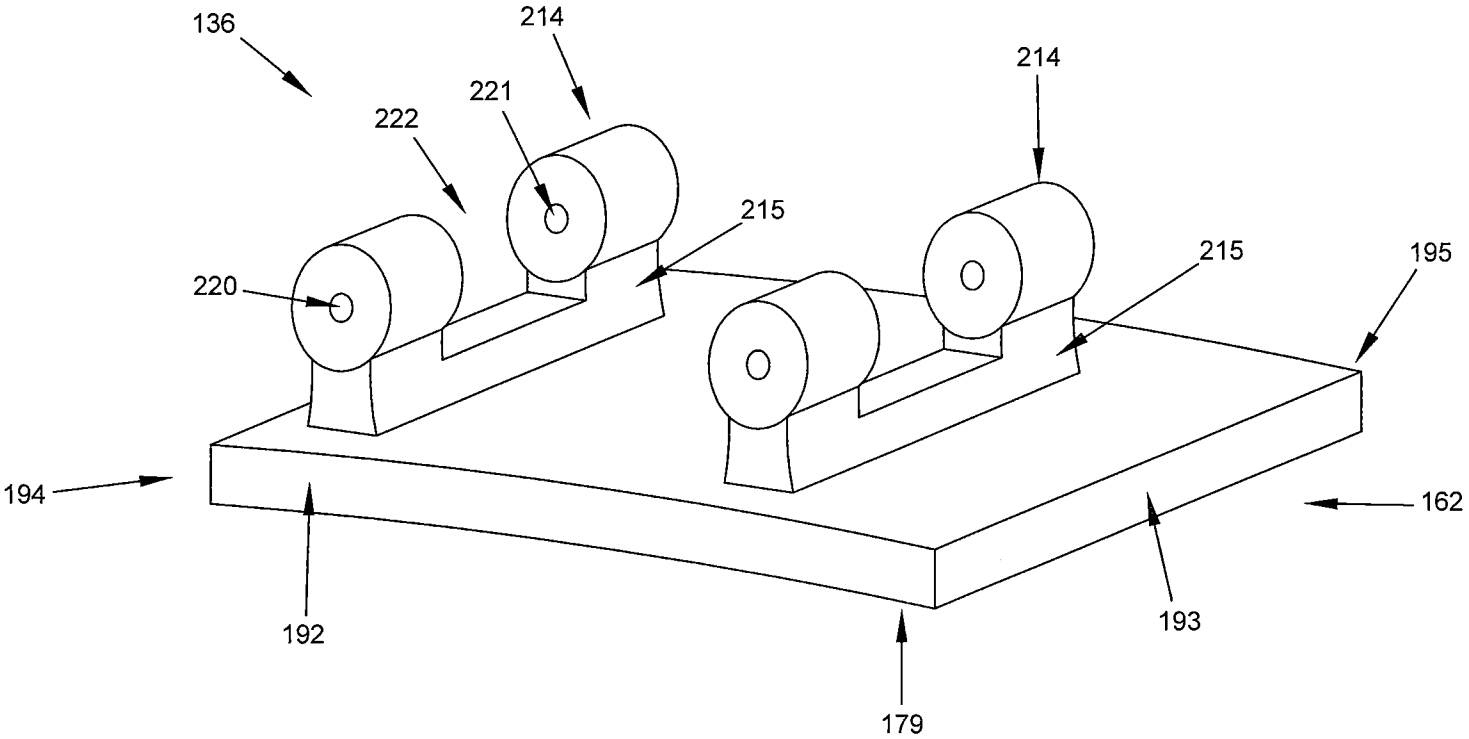
FIG. 21 is a perspective view of the CMC seal segment having a segmented pin bore flange illustrated in FIG. 20.
Figure 22:
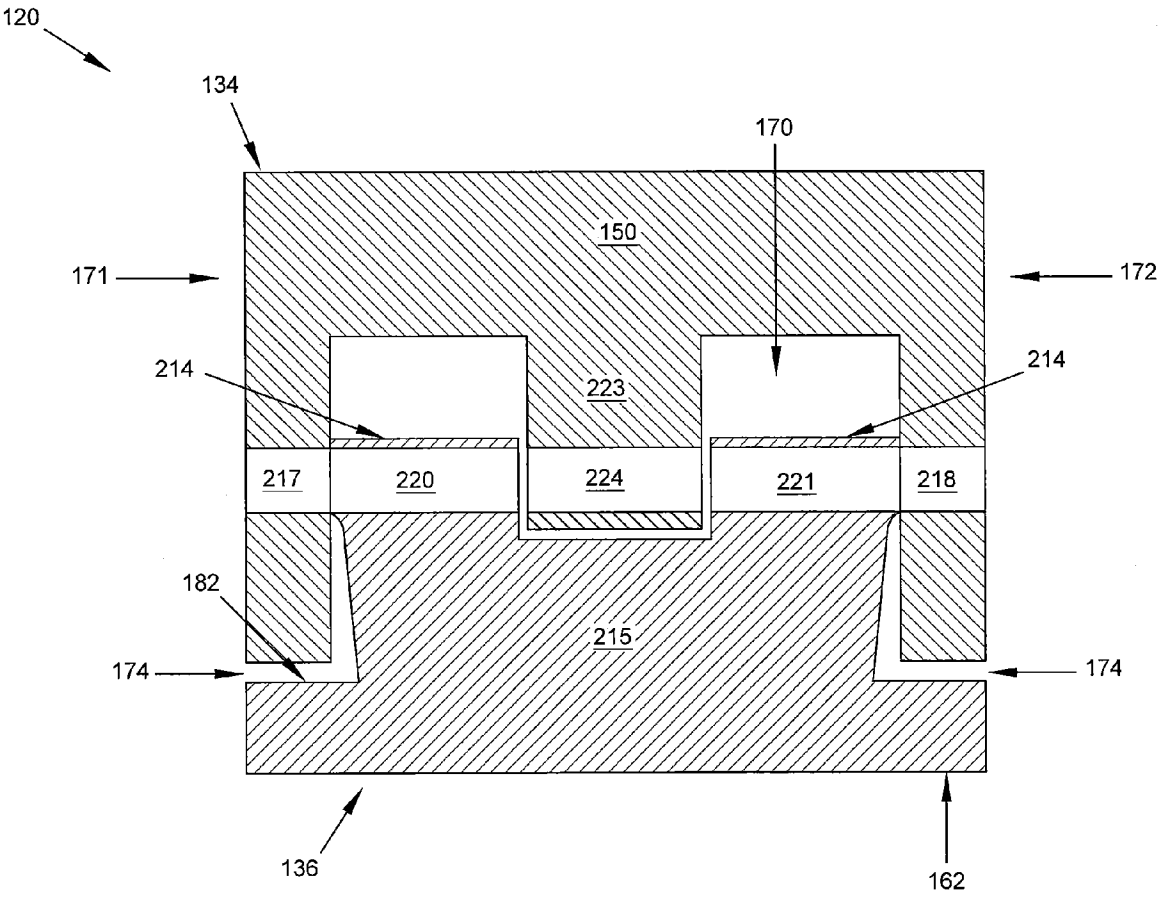
FIG. 22 is an axial cross-sectional view of a CMC seal segment having a segmented pin bore flange aligned with a carrier segment.

In another embodiment, CMC seal segment 136 comprises an arcuate flange 162 and one or more segmented pin bore flanges 214. FIG. 20 is an axial profile view of the first axial edge 193 of a CMC seal segment 136 having a segmented pin bore flange 214 in accordance with some embodiments. FIG. 21 is a perspective view of the CMC seal segment 136 having a segmented pin bore flange 214 illustrated in FIG. 20. FIG. 22 is an axial cross-sectional view of a CMC seal segment 136 having a segmented pin bore flange 214 aligned with a carrier segment 134 in accordance with some embodiments.

FIGS. 20 and 21 illustrate a CMC seal segment 136 having a segmented pin bore flange 214 which defines a forward segment bore 220 and an aft segment bore 221. Segmented pin bore flange 214 is connected to arcuate flange 162 by a modified spacing flange 215. In some embodiments, modified spacing flange 215 defines a groove 222 adapted to receive a central flange 223 of carrier segment 134.

A carrier segment 134 is illustrated in FIG. 22 having an axial flange 150 and one or more lateral flanges 171, 172 extending radially inward from the axial flange 150. Forward lateral flange 171 defines a forward through-thickness bore 217. Aft lateral flange 172 defines an aft through-thickness bore 218. A central flange 223 extends radially inward from axial flange 150 and defines a central carrier bore 224. Axial flange 150, forward lateral flange 171, aft lateral flange 172, and arcuate flange 162 together define a cavity 170.

CMC seal segment 136 is positioned in cavity 170 such that forward segment bore 220 and aft segment bore 221 align with forward through-thickness bore 217, aft through-thickness bore 218, and central carrier bore 224. Thus an elongated pin 210 can be passed through forward through-thickness bore 217, forward segment bore 220, central carrier bore 224, aft segment bore 221, and aft through-thickness bore 218 to connect CMC seal segment 136 to carrier segment 134. A mating region 174 is defined proximate the entire perimeter of outward-facing surface 182 of the arcuate flange 162 of CMC seal segment 136.

Figure 23:
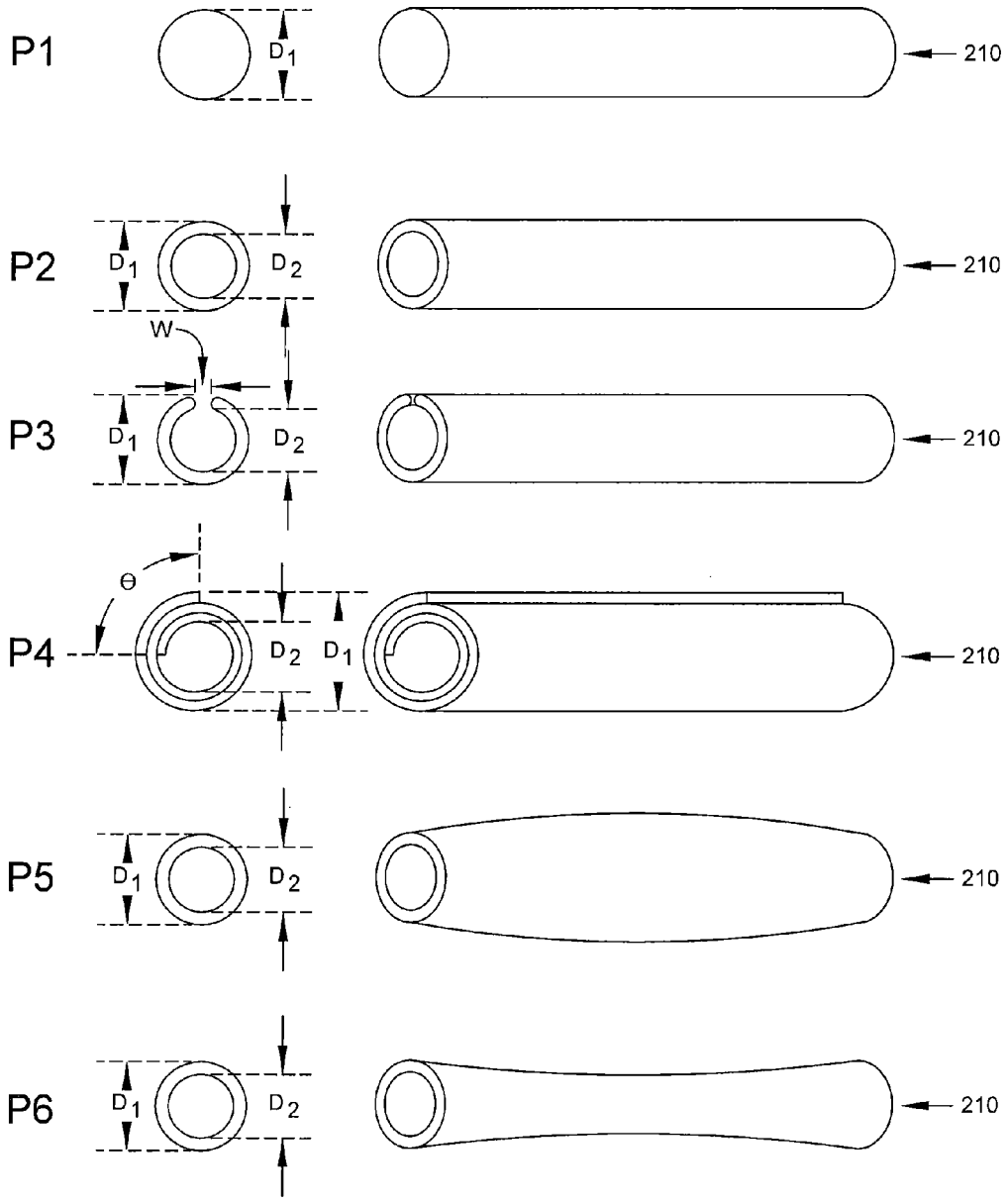
FIG. 23 provides a profile view of the forward edge of a plurality of elongated pins and a perspective view of the same.

A variety of elongated pins 210 are contemplated for use with the disclosed CMC seal segment 136. FIG. 23 provides a profile view of the forward edge of a plurality of elongated pins and a perspective view of the same.

First elongated pin P1 comprises a solid pin. In some embodiments, first elongated pin P1 has a continuously curved or circular lateral cross-section. The illustrated first elongated pin P1 comprises a uniform outer lateral cross-sectional dimension $D_1$. In some embodiments, first elongated pin P1 has an outer lateral cross-sectional dimension $D_1$ of at least three-eighths inches, one half inch, five-eighths inches, or greater.

Second elongated pin P2 comprises a hollow pin. The illustrated second elongated pin P2 comprises a uniform inner lateral cross-sectional dimension $D_2$ and uniform outer lateral cross-sectional dimension $D_1$. In some embodiments, second elongated pin P2 has at least one continuously curved cross section $D_1$ or $D_2$. In some embodiments, inner lateral cross-sectional dimension $D_2$ and outer lateral cross-sectional dimension D1 vary along the length of second elongated pin P2. In some embodiments, second elongated pin P2 has an outer lateral cross-sectional dimension $D_1$ of at least three-eighths inches, one half inch, five-eighths inches, or greater. Hollow pins are advantageous for use in a pinned CMC seal segment as they allow for passing a bolt or similar attachment mechanism through the pin in order to secure a cover plate, cover seal, or static seal to a carrier segment. Hollow pins additionally provide lower radial stiffness which results in a wider contact region between pin and segment bore, and therefore results in lower contact stress. Further, a hollow pin has a lower weight than solid pins, which can be a concern in gas turbine engines.

Third elongated pin P3 comprises a split pin. A split pin comprises a hollow pin having a gap of width W. The illustrated third elongated pin P3 comprises a uniform inner lateral cross-sectional dimension $D_2$ and uniform outer lateral cross-sectional dimension $D_1$. In some embodiments, inner lateral cross-sectional dimension $D_2$ and outer lateral cross-sectional dimension D1 vary along the length of third elongated pin P3. In some embodiments, third elongated pin P3 has an outer lateral cross-sectional dimension $D_1$ of at least three-eighths inches, one half inch, five-eighths inches, or greater. Split pins are advantageous for use in a pinned CMC seal segment as they provide a reduced circumferential stress when compared to solid pins.

Fourth elongated pin P4 comprises a spiral rolled pin. A spiral rolled pin is formed from a sheet of material, typically metal alloy material, which is rolled into a cylinder. In some embodiments, a spiral rolled pin has several layers. The angle between a first end of the rolled material and a second end of the rolled material is measured as θ. In some embodiments, θ is between 45 degrees and 135 degrees. The illustrated fourth elongated pin P4 comprises a constantly increased radii from a minimum inner lateral cross-sectional dimension $D_2$ to a maximum outer lateral cross-sectional dimension $D_1$. In some embodiments, inner lateral cross-sectional dimension $D_2$ and outer lateral cross-sectional dimension D1 vary along the length of fourth elongated pin P4. In some embodiments, fourth elongated pin P4 has an outer lateral cross-sectional dimension $D_1$ of at least three-eighths inches, one half inch, five-eighths inches, or greater. Spiral rolled pins are advantageous for use in a pinned CMC seal segment as they provide high radial compliance, reduced tensile and contact stresses, and have a high shear strength.

In still further embodiments, the lateral cross-sectional dimension of elongated pin 210 varies along the length of elongated pin 210. For example, fifth elongated pin P5 comprises a barreled pin having a greater lateral cross-sectional dimension at the longitudinal center than at either of opposing ends of the pin P5. Conversely, sixth elongated pin P6 comprises a crowned pin having a greater lateral cross-sectional dimension at either of opposing ends than at the longitudinal center of the pin P6. In still further embodiments, an elongated pin 210 has a minimum lateral cross-sectional dimension at a proximate end and a maximum lateral cross-sectional dimension at a distal end of the elongated pin 210. In some embodiments, pins such as elongated pins P5 and P6 improve the distribution of contact stresses between the elongated pin 210 and the segment bore 181 and or carrier bores, and also reduce edge loading. In some embodiments, elongated pins P5 and P6 are hollow as illustrated in FIG. 23; however, in other embodiments elongated pins P5 and P6 are solid.

Elongated pins 210 with varying lateral cross-sectional dimensions are adapted to account for deflections of the pin and bore during operation such that a uniform load distribution occurs along the length of the segment bore 181. These types of pin profiles additionally tend to pull the pin surface away from the bore at the pin ends to avoid concentrated edge loading in the segment bore 181. In some embodiments such as illustrated in FIGS. 18 and 19, the segment bore 181 also has a varying lateral cross-sectional dimension to further assist with load distribution.

In some embodiments, an elongated pin 210 used in the assembly of shroud segment 120 is formed from a high temperature nickel alloy or cobalt alloy. In some embodiments, an elongated pin 120 is formed from a metal alloy. In other embodiments, an elongated pin 120 is formed from ceramic material.

In some embodiments, an elongated pin 210 used in the assembly of shroud segment 120 is coated with an aluminide compound. An aluminide coating prevents or slows corrosion caused by silica-based CMC material interacting with a metal pin at the high operating temperatures typical for a gas turbine engine.

Figure 24:
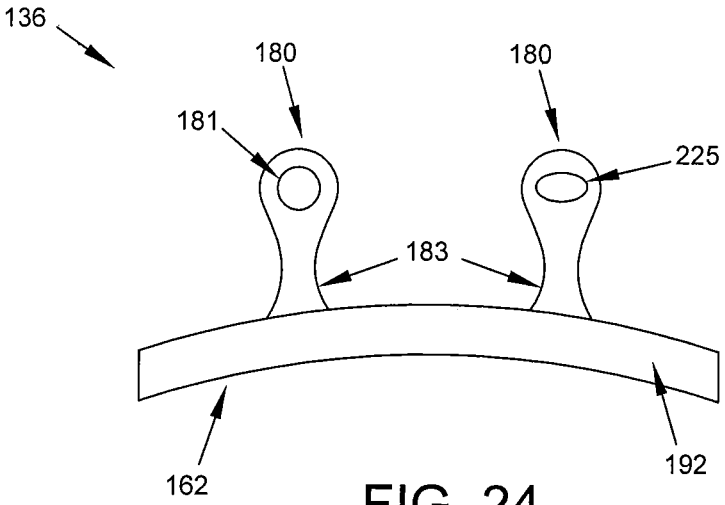
FIG. 24 is a profile view of the forward edge of a CMC seal segment having a segment bore with a circular lateral cross-section and a slotted bore.

Additional embodiments are disclosed with variations in the number or design of pin bore flanges 180. FIG. 24 is a profile view of the forward edge 192 of a CMC seal segment 136 having a segment bore 181 with a circular lateral cross-section and a slotted bore 225 in accordance with some embodiments. Both segment bore 181 and slotted bore 225 are adapted to align with bores of a carrier segment 134 when shroud segment 120 is assembled. Slotted bore 225 provides space for movement of the CMC seal segment 136 relative to the carrier segment 134 due to different rates of thermal expansion resulting from construction from unlike materials. Slotted bore 225 thus reduces contact stresses on both CMC seal segment 136 and carrier segment 134.

Figure 25:
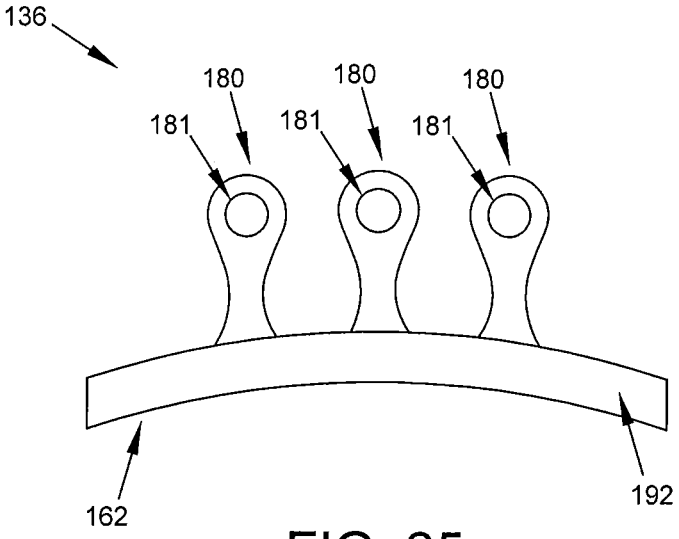
FIG. 25 is a profile view of the forward edge of a CMC seal segment having three pin bore flanges.

FIG. 25 is a profile view of the forward edge 192 of a CMC seal segment 136 having a three pin bore flanges 180 in accordance with some embodiments. The three segment bores 181 are adapted to align with bores of a carrier segment 134 when shroud segment 120 is assembled. As illustrated in FIG. 25, in some embodiments all three segment bores 181 have a circular lateral cross-section. In other embodiments, all three segment bores 181 have a lateral cross-section with a continuously curved surface. In still further embodiments, one or more of the pin bore flanges 180 defines a slotted bore 225. Additional embodiments of a CMC seal segment 136 are contemplated having more than three pin bore flanges 180.

Figure 29:
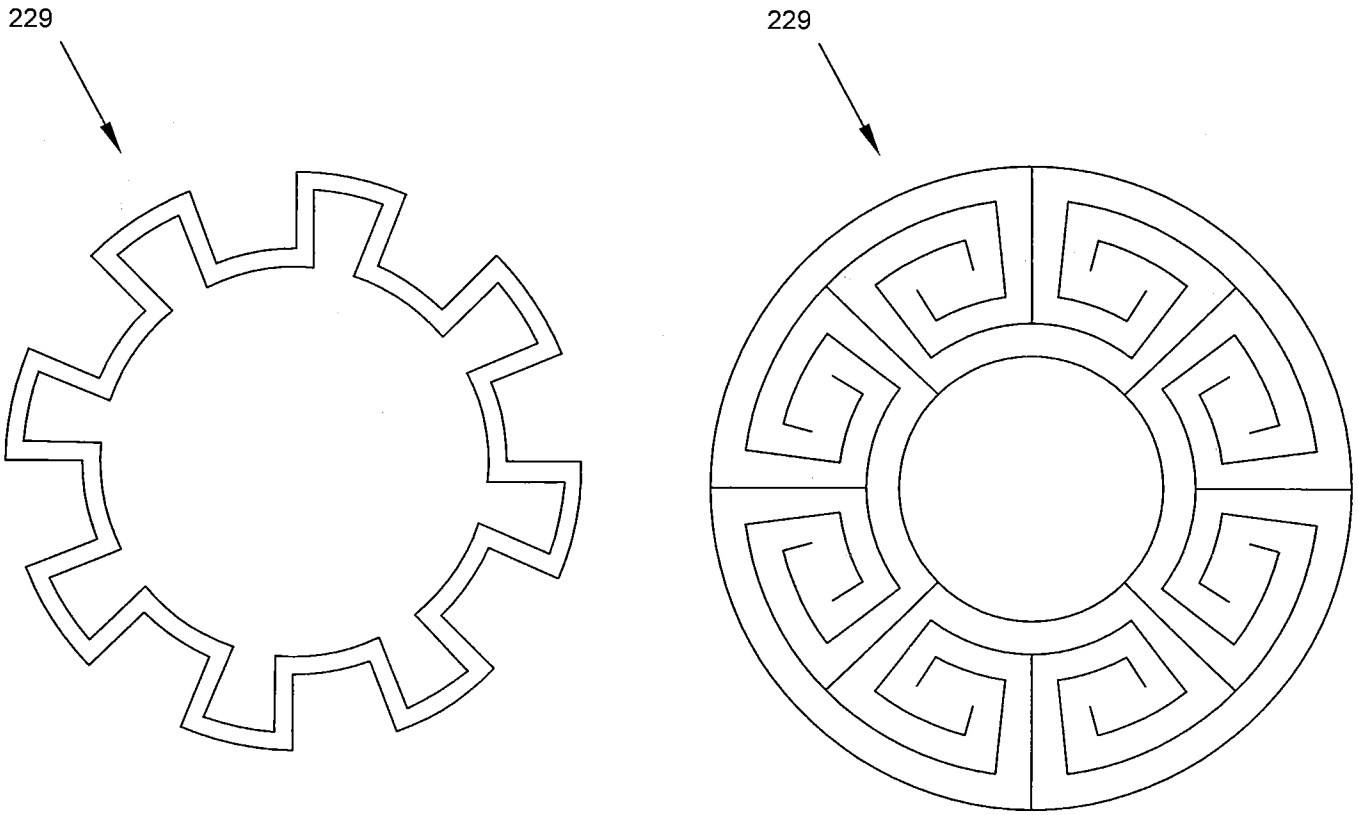
FIG. 29 is a radial profile view of two embodiments of a radially compliant bushing.

In some embodiments of the disclosed CMC seal segment 136, bushings 228 or bore liners are disposed within segment bore 181 to improve pin load distribution along the length of segment bore 181, to act as a thermal and/or diffusion barrier between the segment bore 181 and elongate pin 210, and to minimize wear caused by relative movement between the segment bore 181 and elongated pin 210 caused by thermal expansion differences. FIG. 29 is a radial profile view of two radially compliant bushings 229 in accordance with some embodiments.

Figure 28:
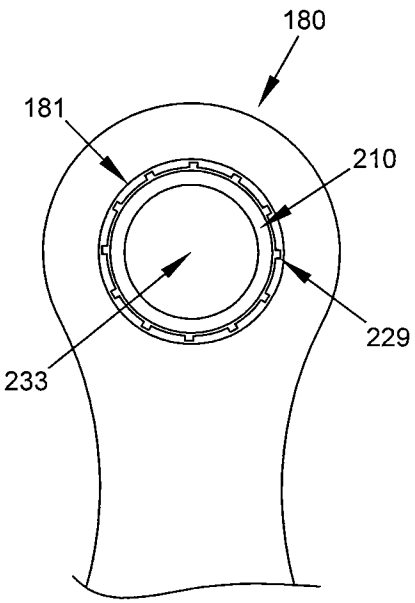
FIG. 28 is a detailed radial profile view of an elongated pin disposed within a radially compliant bushing which is disposed within a segment bore.
Figure 27:
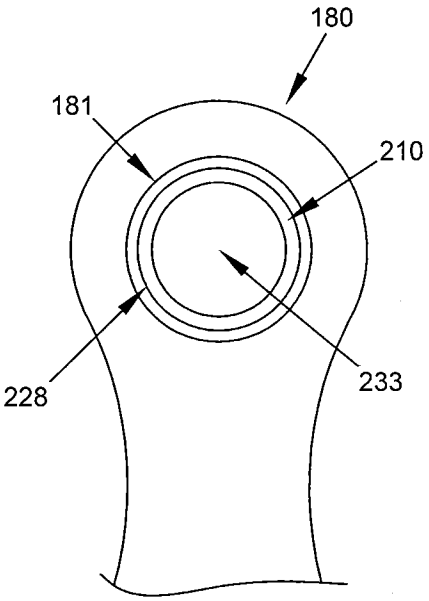
FIG. 27 is a detailed radial profile view of an elongated pin disposed within a bushing which is disposed within a segment bore.
Figure 26:
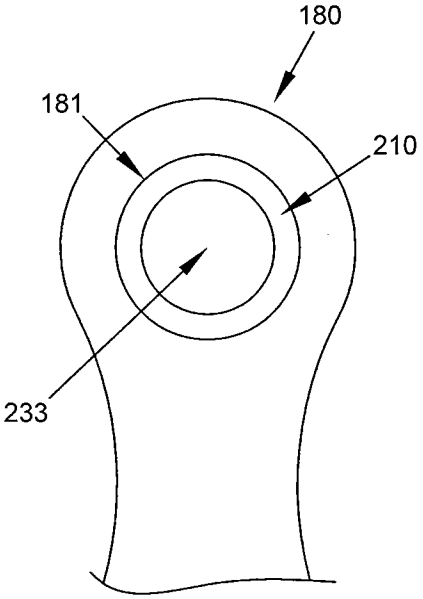
FIG. 26 is a detailed radial profile view of an elongated pin disposed within a segment bore.

FIG. 26 is a detailed radial profile view of an elongated pin 210 disposed within a segment bore 181. The elongated pin 210 illustrated in FIG. 26 is a hollow pin which defines a void 233. FIG. 27 is a detailed radial profile view of an elongated pin 210 disposed within a bushing 228 which is disposed within a segment bore 181. The elongated pin 210 illustrated in FIG. 26 is a hollow pin which defines a void 233. FIG. 28 is a detailed radial profile view of an elongated pin 210 disposed within a radially compliant bushing 229 which is disposed within a segment bore 181. The elongated pin 210 illustrated in FIG. 26 is a hollow pin which defines a void 233.

In some embodiments, bushing 228 is formed from monolithic ceramic material, silicon-mononitride, silicon-nitride, or other suitable bushing material which may be bonded, welded, use a bimetallic clip, or attached to the segment bore 181 via another suitable mechanism. In other embodiments, bushing 228 is formed from a metal alloy such as a high temperature nickel alloy or cobalt alloy. The bushing 228 may also be manufactured using a cylindrical sleeve weave in order to ensure the bushing carries hoop stresses.

Figure 30:
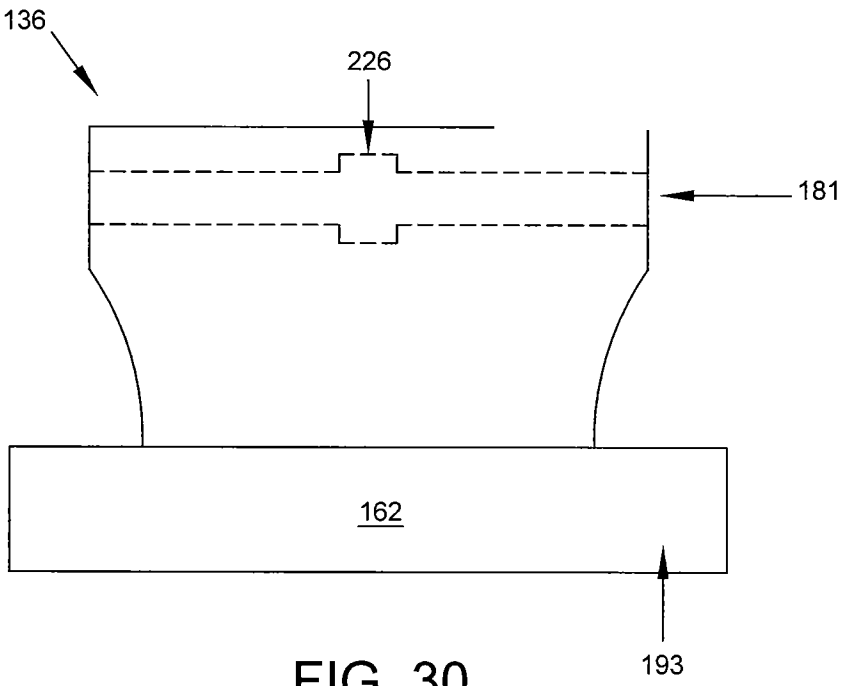
FIG. 30 is an axial profile view of the first axial edge of a CMC seal segment having a segment bore with a retention feature.

A further embodiment is provided wherein a CMC seal segment 136 includes a segment bore 181 with a retention feature 226. FIG. 30 is an axial profile view of the first axial edge 193 of a CMC seal segment 136 having a segment bore 181 with a retention feature 226 in accordance with some embodiments. In some embodiments, retention feature 226 comprises a groove disposed circumferentially within segment bore 181. An elongated pin 210 having a corresponding member for engaging retention feature 226 is inserted into segment bore 181 and, upon engaging retention feature 226, provides reduced axial movement of the elongated pin 210 within the segment bore 181. In embodiments having a bushing 228 disposed within the segment bore 181, the bushing 228 may have a corresponding member for engaging retention feature 226 and be inserted into segment bore 181 and, upon engaging retention feature 226, provide reduced axial movement of the bushing 228 within the segment bore 181. The disclosed member can take many forms, such as a full circumferential rib, an interrupted or segmented circumferential rib, a square or rectangular lateral cross-section, or a tapered outer diameter.

Figure 31:
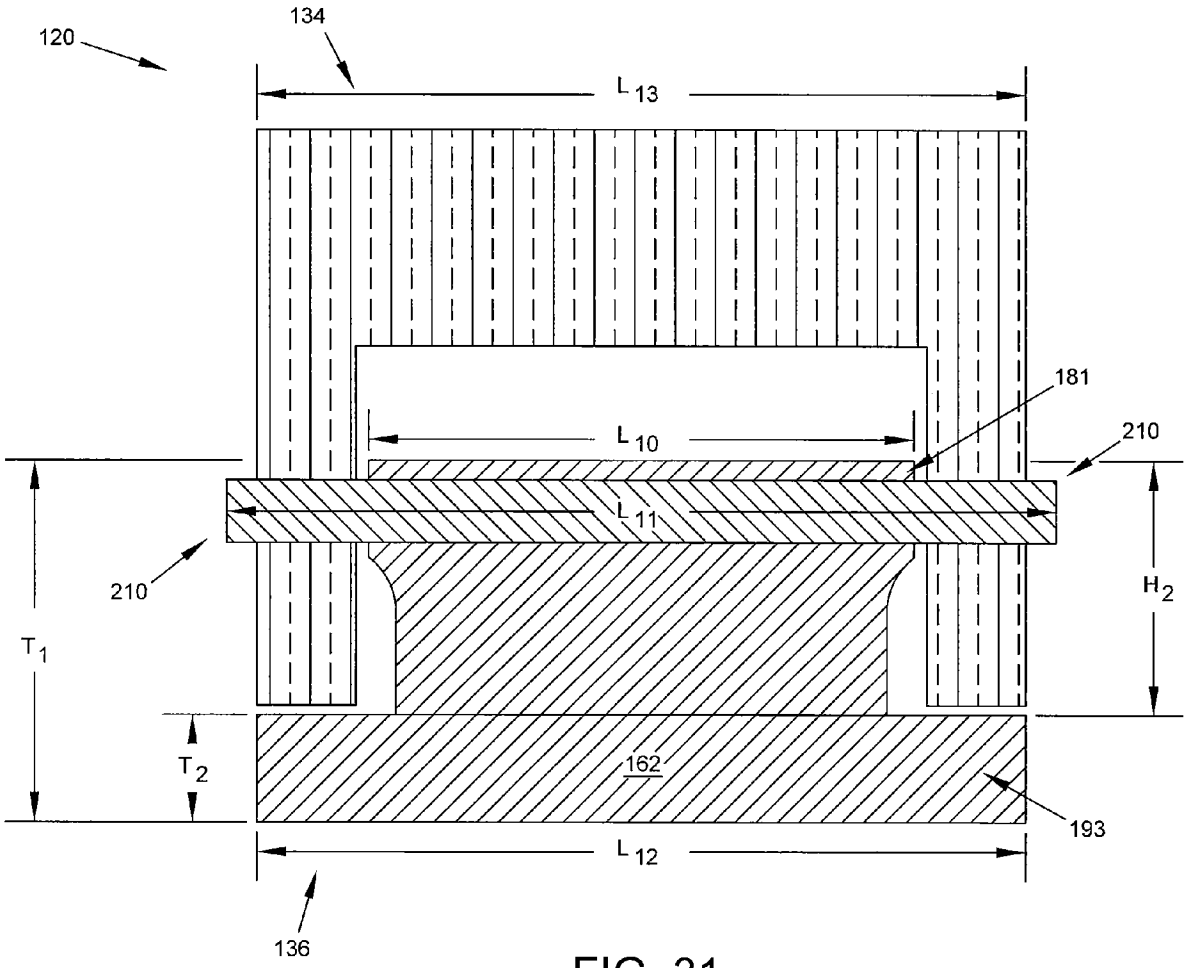
FIG. 31 is an axial cross-sectional view of a CMC seal segment aligned with a carrier segment illustrating various relative dimensions.

Relative dimensions are disclosed of advantageous embodiments of a CMC seal segment 136. FIG. 31 is an axial cross-sectional view of a CMC seal segment 136 aligned with a carrier segment 134 illustrating various relative dimensions. For example, in some embodiments, the length $L_{10}$ of segment bore 181 is between 50% and 90% of the length $L_{11}$ of elongated pin 210. In some embodiments, length $L_{10}$ is between 60% and 70% of length $L_{11}$. In further embodiments, length $L_{10}$ is at least 70% of length $L_{11}$.

Another comparison is provided between length $L_{10}$ and the length $L_{12}$ of first axial edge 193 of the arcuate flange 162 of CMC seal segment 136. In some embodiments, length $L_{10}$ is at least 85% of length $L_{12}$. In other embodiments, length $L_{10}$ is at least 75% of length $L_{12}$.

Similarly, in some embodiments length $L_{10}$ is between 50% and 90% of the length $L_{13}$ in the axial direction of carrier segment 134. In some embodiments, length $L_{10}$ is between 60% and 70% of length $L_{13}$. In further embodiments, length $L_{10}$ is at least 70% of length $L_{13}$.

In some embodiments, the height $H_2$ of the radial member is greater than the thickness $T_2$ of the arcuate flange 162. The height $H_2$ may be twice or more than the thickness $T_2$ of the arcuate flange 162. Spacing the segment bore 181 radially away from the flow path allows for the use of larger pins and other advantages as discussed below.

Finally, in some embodiments length $L_{10}$ is greater than the thickness $T_1$ of CMC seal segment 136. In some embodiments length $L_{10}$ is greater than the thickness $T_2$ of arcuate flange 162.

The above disclosed CMC seal segment 136 embodiments provide numerous advantages over the prior art. First, an elongate pin 210 is passed through a segment bore 181 and is supported on both ends by carrier bores. This design is advantageous over the prior art of cantilevered pins passed through through-thickness bores because it provides additional structural support for the pin and reduces pin deflection. Reduced pin deflection in turn results in reduced edge loading since such edge loading is typically caused by pin deflection against a stiff CMC segment bore. An elongate pin supported on both ends by carrier bores also improves load distribution across the pin.

Second, segment bores 181 are elongate, and in some embodiments are greater than one half inch. Elongated segment bores 181 are an improvement over through-thickness bores in that they provide additional structural support for the pin and allow for other carrier bore design features such as chamfers and surface profiling. Chamfering is possible in elongated segment bores 181 and helps prevent spalling of coating on surrounding surfaces by avoiding contact or by reducing edge loading between the pin and the coating. A shallower angle is better for minimizing edge loading, with the particular angle also being affected by any profiling to the pin and bore. Additionally, in cantilevered carrier bores as the length of the cantilevered member increases the vertical (radial) stress of the elongated pin on the carrier bore is reduced.

Third, segment bores 181 with a larger lateral cross-sectional dimension than those found in the prior art provides a greater bearing area, reduced peak contact stress, minimized pin bending and deflection, and avoidance of interference fit at operating temperatures. In some embodiments the segment bores 181 lateral cross-sectional dimension is greater than three-eighths of an inch. This greater lateral cross-sectional dimension is possible with the use of the spacing flange 183.

Fourth, the spacing flange 183 further distances the carrier and CMC segment bores 190, 181 and the elongated pins from the high temperature flow path and allows cooling air to flow around these components within the cavity 170. This results in drastically lower temperatures which minimizes the thermal stresses caused by differing thermal expansion rates of these components. As one example, the operating temperature of the flow path can reach 2800-2900 degrees F. with the inner- and outward-facing surfaces 179, 182 of the arcuate surface 162 reaching temperatures of 2150-2300 degrees F., and 1800 degrees F., respectively. By spacing the segment bore 181 with the spacing flange 183, the temperature proximate the elongated pin, segment bore 181, and carrier bore 190 may be reduced to as little as 1400 degrees F., or lower.

Flexible Mounting of CMC Seal Segment

Another embodiment of the present disclosure is directed to a system and method of reducing stresses caused by varying rates of thermal expansion between unlike material components by providing flexible mounting of a CMC seal segment to a carrier segment. CMC materials have low thermal conductivity and low thermal expansion, leading to differential thermal expansion relative to non-CMC components such as elongated pins and carrier segments. These differential thermal expansions cause high stress in mating areas where CMC and non-CMC components are in close proximity. Such stresses are of particular concern given the low allowable stress of CMC materials such as a CMC seal segment.

Figure 32:
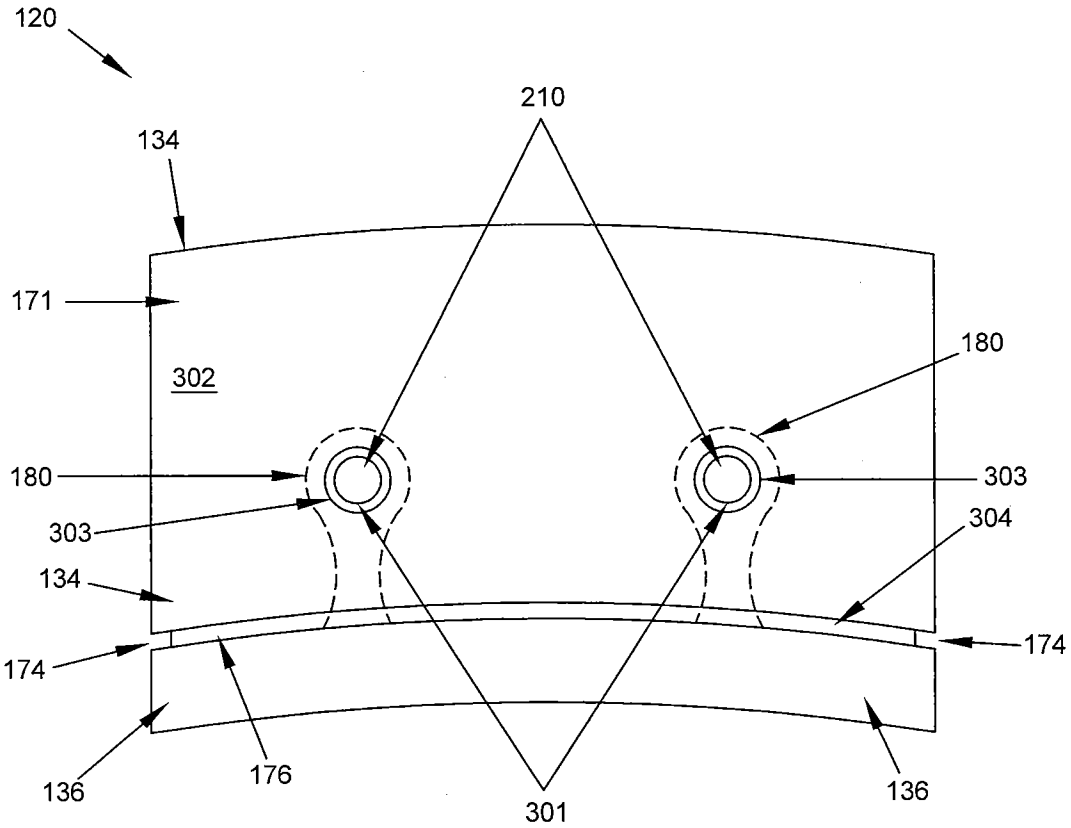
FIG. 32 is a radial profile view of the forward-facing surface of a carrier segment having a carrier bore bushing disposed in each of one or more cantilevered carrier bores.
Figure 33:
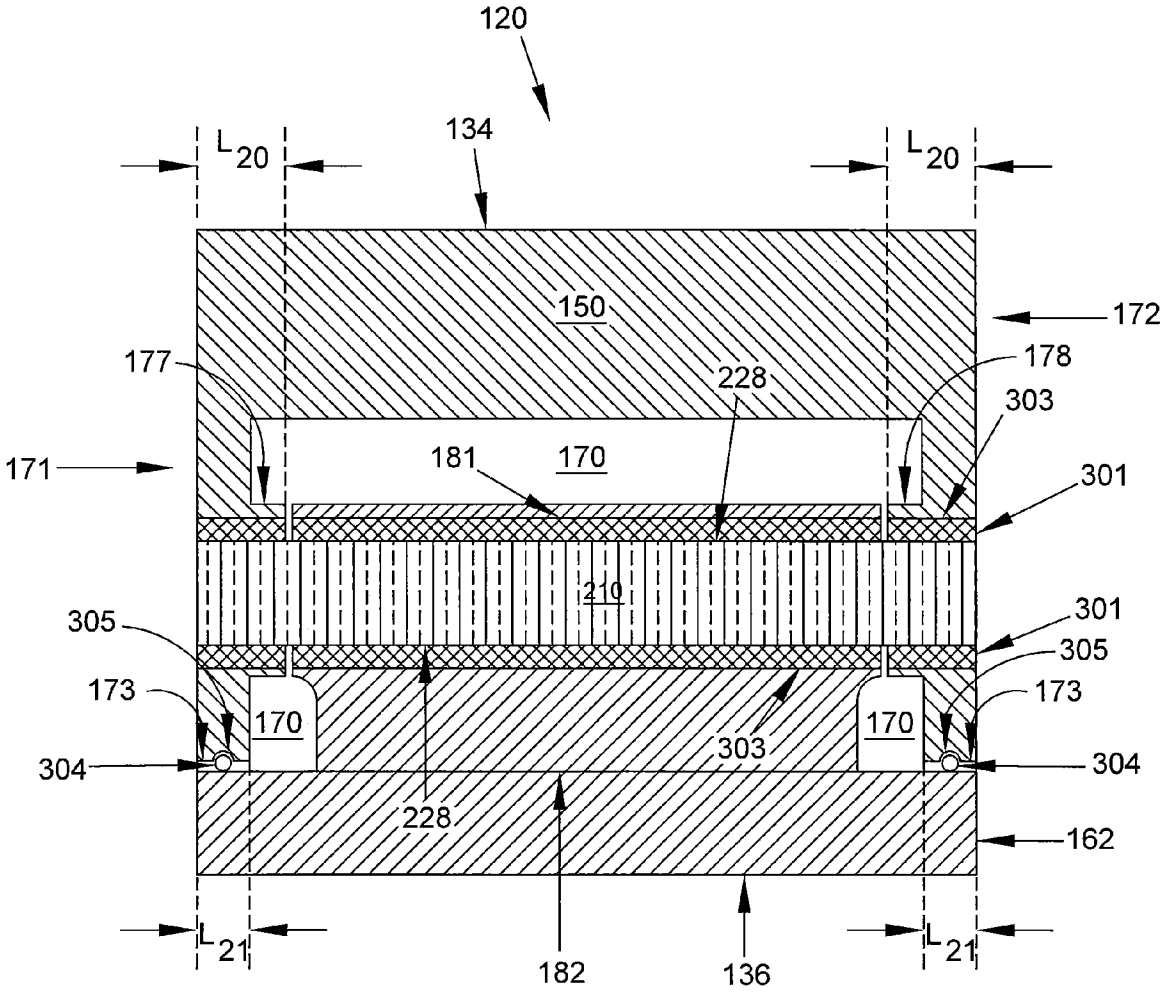
FIG. 33 is an axial cross-sectional view of a carrier segment having a carrier bore bushing disposed in each of one or more cantilevered carrier bores.

In an embodiment of providing flexible mounting of a CMC seal segment 136 to carrier segment 134, the carrier segment 134 has a carrier bore bushing 301 disposed in each of a plurality of cantilevered carrier bores. An exemplary embodiment is provided in FIGS. 32 and 33. FIG. 32 is a radial profile view of the forward-facing surface 302 of a carrier segment 134 having a carrier bore bushing disposed in each of one or more cantilevered carrier bores 303. FIG. 33 is an axial cross-sectional view of a carrier segment 134 having a carrier bore bushing 301 disposed in each of one or more cantilevered carrier bores 303.

As illustrated in FIG. 32, forward flange 171 of carrier segment 134 defines a pair of carrier bores 303. Each of the carrier bores 303 includes a carrier bore bushing 301 disposed within. Carrier bore bushings 301 are used to improve pin load distribution along the length of carrier bore 303, to act as a thermal and/or diffusion barrier between the carrier bore 303 and elongate pin 210, and to minimize wear caused by relative movement between the carrier bore 303 and elongated pin 210. In some embodiments, carrier bore bushing 301 is formed from monolithic ceramic material. In other embodiments, carrier bore bushing 301 is formed from a metal alloy such as a high temperature nickel alloy or cobalt alloy.

An elongate pin 210, exemplary of the solid pin type P1 described above, is disposed within each of the pair of carrier bore bushings 301. The location of a CMC shroud segment 136 having a pair of pin bore flanges 180 is illustrated in dotted lines in FIG. 32 to demonstrate the alignment of each segment bore 181 of the pin bore flanges 180 with a corresponding carrier bore 303.

The elongate pin 210 is further passed through a segment bore 181, as illustrated in FIG. 33. A carrier segment 134 is shown having an axial flange 150 and one or more lateral flanges 171, 172 extending radially inward from the axial flange 150. In some embodiments, a single lateral flange extends radially inward from axial flange 150 around the entire perimeter of axial flange 150.

Forward lateral flange 171 includes a member 177 extending aft axially from the forward lateral flange 171 to define a carrier bore 303 which is cantilevered, having a length $L_{20}$ greater than the axial dimension of the forward lateral flange 171, represented as length $L_{21}$. Aft lateral flange 172 includes a member 178 extending axially forward from the aft lateral flange 172 to define a carrier bore 303 which is cantilevered, having a length $L_{20}$ greater than the axial dimension of the aft lateral flange 172, represented as length $L_{21}$. Axial flange 150, forward lateral flange 171, aft lateral flange 172, and arcuate flange 162 together define a cavity 170.

CMC seal segment 136 is positioned in cavity 170 such that segment bore 181 aligns with the carrier bore 303 defined by forward lateral flange 171 and the carrier bore 303 defined by aft lateral flange 172. A carrier bore bushing 301 is disposed within each carrier bore 303, and a segment bore bushing 228 is disposed within segment bore 181. Thus an elongated pin 210 can be passed through a forward carrier bore bushing 301, segment bore bushing 228, and an aft carrier bore bushing 301 to connect CMC seal segment 136 to carrier segment 134. The elongated pin 210 is illustrated as a solid pin.

In some embodiments, a compressible mating element 304 or plurality of compressible mating elements are arranged along the perimeter of the outer surface 182 of arcuate flange 162 of CMC seal segment 136 as suggested in FIG. 33. Compressible mating element 304 is illustratively a rope seal arranged radially between the carrier segments 134 and the CMC seal segment 136. The compressible mating element 304 blocks gasses from passing through radial interfaces of components included in the shroud segments 120. In other embodiments, other types of seals may be used as compressible mating element 304.

In some embodiments, a groove 305 is defined in the inward-facing surface 173 of one or more lateral flanges 171, 172 and compressible mating element 304 is disposed within the groove 305. In some embodiments, compressible mating element 304 is arranged along only a portion of the perimeter of the outer surface 182 of arcuate flange 162 of CMC seal segment 136. For example, in some embodiments compressible mating element 304 is not arranged along the trailing edge of arcuate flange 162 to allow for venting of cavity 170 into the flow path.

In some embodiments, carrier bore bushings 301 can be of the design disclosed above as radially compliant bushing 229. In some embodiments, segment bore bushing 228 can be replaced with radially compliant bushing 229.

In some embodiments, member 177 (and/or 178) has a length $L_{20}$ sufficient to effect radial flexion between the member 177 (178) and the elongate pin 210 disposed within the carrier bore 303 defined by the member 177 (178). For example, in some embodiments member 177 (178) has a length $L_{20}$ which is at least 120% the axial dimension $L_{21}$ of the one or more lateral flanges 171, 172.

In some embodiments, a carrier bore 303 is defined having a continuously curved lateral cross-section. In some embodiments a carrier bore 303 is defined having a circular lateral cross-section. Further, in some embodiments carrier bore 303 has a lateral cross-sectional dimension of at least three-eighths inches, one half inch, five-eighths inches, or greater.

Figure 34:
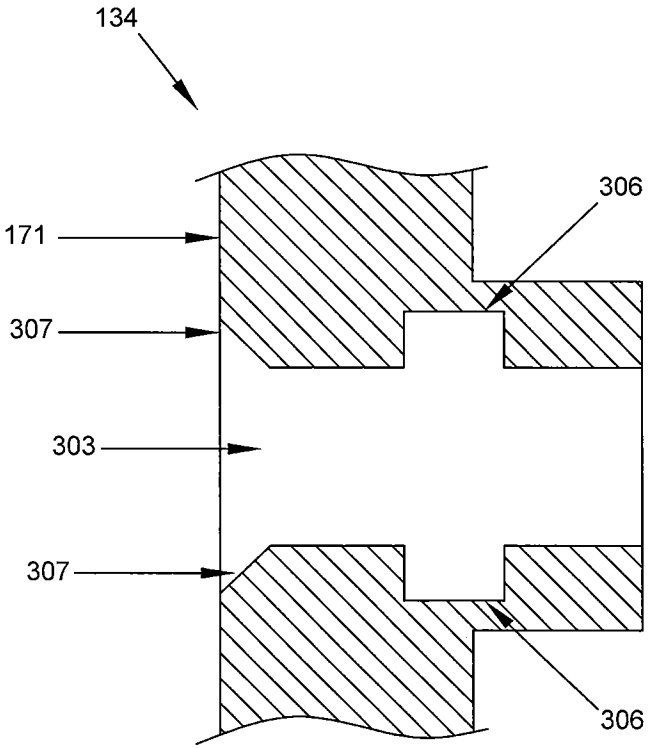
FIG. 34 is an axial cross-sectional view of a carrier bore having a chamfered forward end and carrier bore retention feature.

FIG. 34 presents further options for configuring carrier bore 303 to provide flexible mounting and improved load distribution between elongated pin 210 and carrier segment 134. FIG. 34 is an axial cross-sectional view of a carrier bore 303 having a chamfered forward end 307 and carrier bore retention feature 306.

Carrier bore 303 includes a chamfered forward end 307. In some embodiments, carrier bore 303 has opposing chamfered ends.

In an exemplary embodiment, carrier bore retention feature 306 comprises a groove disposed circumferentially within carrier bore 303. An elongated pin 210 having a corresponding member for engaging retention feature 306 is inserted into carrier bore 303 and, upon engaging retention feature 306, provides reduced axial movement of the elongated pin 210 within the carrier bore 303. In embodiments having a carrier bore bushing 301 disposed within the carrier bore 303, the carrier bore bushing 301 may have a corresponding member for engaging retention feature 306 and be inserted into carrier bore 303 and, upon engaging retention feature 306, provide reduced axial movement of the carrier bore bushing 301 within the carrier bore 303. The disclosed member can take many forms, such as a full circumferential rib, an interrupted or segmented circumferential rib, a square or rectangular lateral cross-section, or a tapered outer diameter.

Although the embodiment described above with respect to FIGS. 32, 33 and 34 is illustrated with carrier bores 303 which are cantilevered, additional embodiments are envisioned having through-thickness bores such as through-thickness bores 217, 218 illustrated in FIG. 17 and discussed above.

Figure 35:
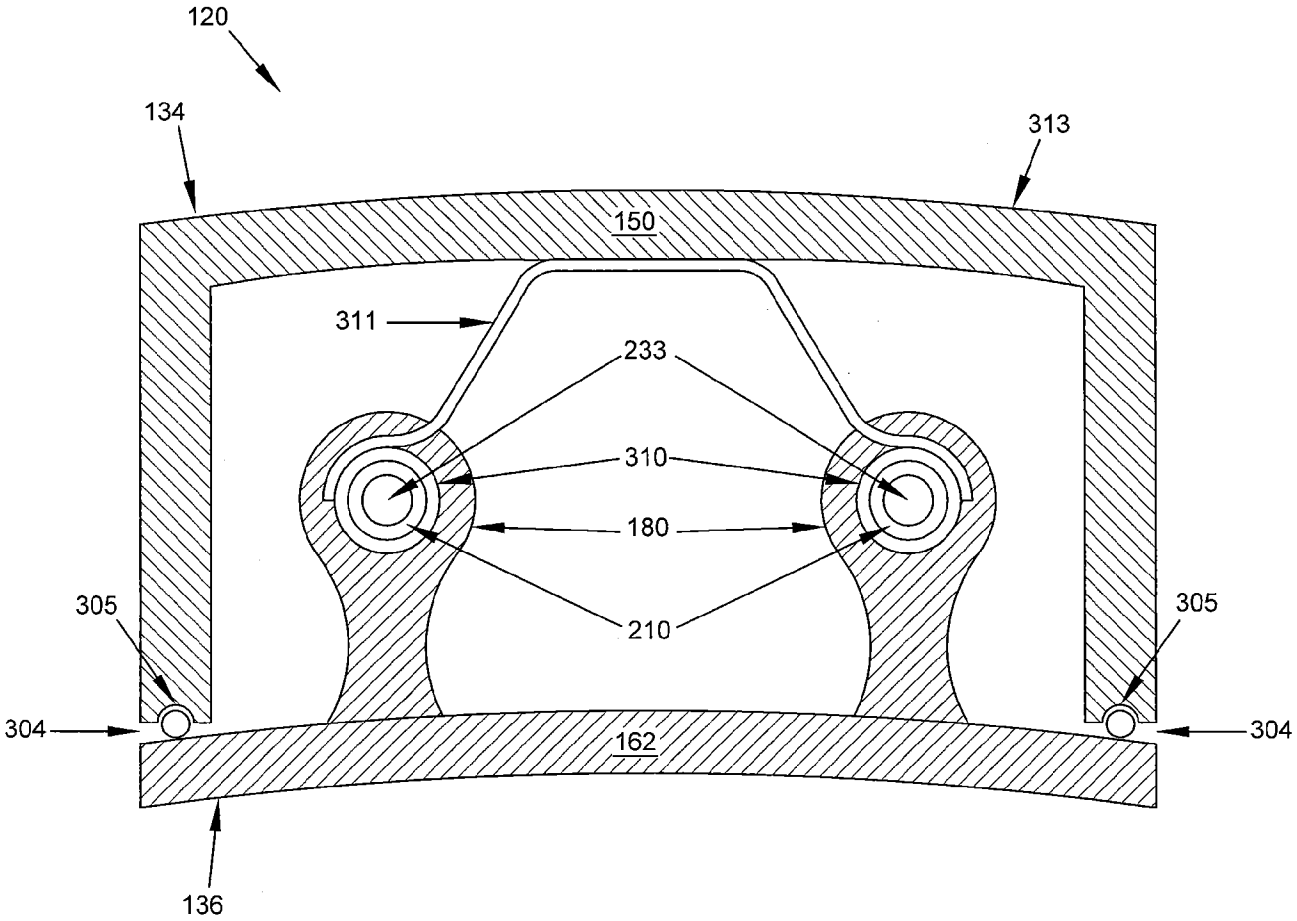
FIG. 35 is a radial cross-sectional view of a shroud segment wherein a carrier segment has a mount bushing and flexible member.
Figure 36:
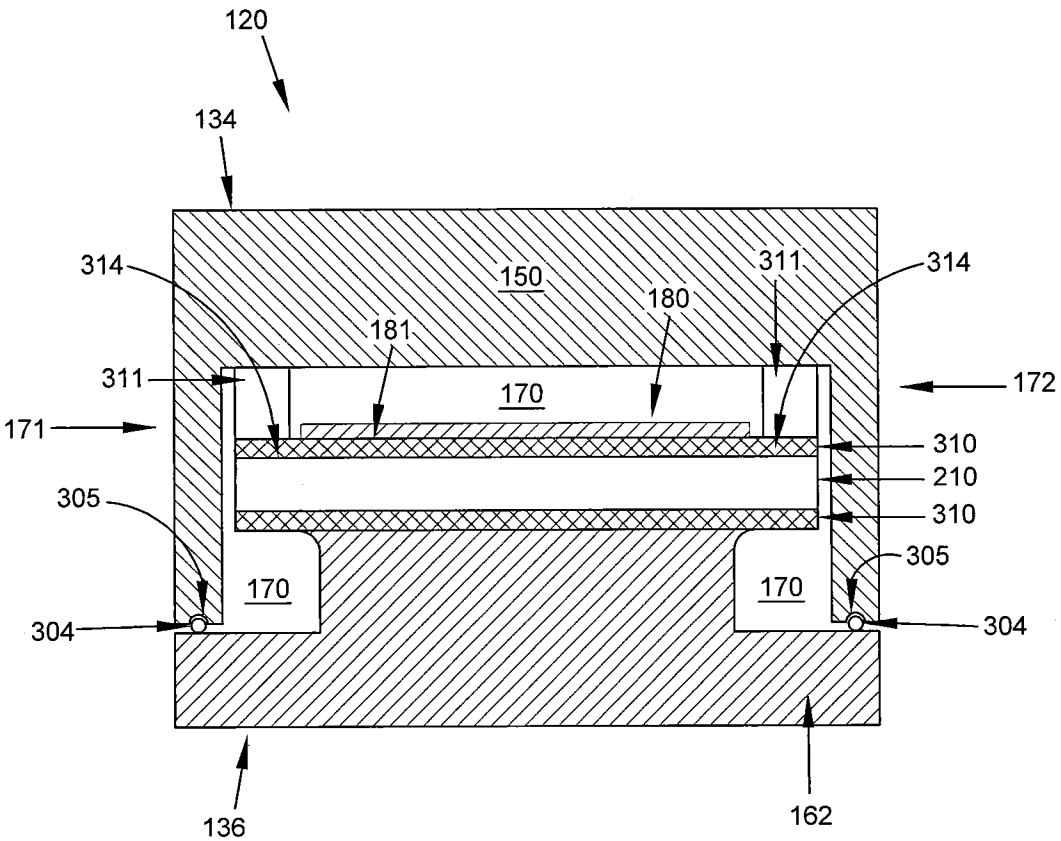
FIG. 36 is an axial cross-sectional view of a shroud segment wherein a carrier segment has a mount bushing and flexible member.

In further embodiments, a carrier segment 134 includes a mount bushing 310 connected to axial flange 150 by a flexible member 311. FIG. 35 is a radial cross-sectional view of a shroud segment 120 wherein a carrier segment 134 has a mount bushing 310 and flexible member 311 in accordance with some embodiments. FIG. 36 is an axial cross-sectional view of a shroud segment 120 wherein a carrier segment 134 has a mount bushing 310 and flexible member 311 in accordance with some embodiments.

In some embodiments, axial flange 150 is generally planar. In other embodiments, such as the embodiment illustrated in FIG. 35, axial flange 150 has an outer-facing surface 313 which is generally curved in a similar manner to the curvature of arcuate flange 162 of the CMC seal segment 136.

Mount bushing 310 is connected to axial flange 150 by flexible member 311. Flexible member 311 provides a degree of flexibility to the mounting to allow for slight relative motion between the carrier segment 134 and the CMC seal segment 136 when assembled as shroud segment 120. In some embodiments, flexible member 311 is formed from a metal alloy. In some embodiments, flexible member 311 is formed from sheet metal.

Based on shape, size, and materials selected for construction, flexible member 311 is designed to achieve a desired degree of radial, lateral, and/or axial flexion during gas turbine operations. In some embodiments, flexible member 311 has a radial stiffness greater than the lateral stiffness. In other embodiments, flexible member 311 has a lateral stiffness greater than the radial stiffness.

As shown in FIG. 36, a mount bushing 310 is disposed within the segment bore 181 and laterally extends forward and aft beyond segment bore 181. Each mount bushing 310 defines the mount bushing bore 314. The elongated pin 210, here illustrated as a solid pin, is disposed within the mount bushing bore 314. In some embodiments, a mount bushing bore 314 is defined having a continuously curved lateral cross-section. In some embodiments a mount bushing bore 314 is defined having a circular lateral cross-section. Further, in some embodiments mount bushing bore 314 has a lateral cross-sectional dimension of at least three-eighths inches, one half inch, five-eighths inches, or greater. In some embodiments mount bushing 310 is formed from metal alloy, while in other embodiments mount bushing 310 is formed from ceramic material. In some embodiments the mount busing 310 and the flexible member 311 are machined as an integral component.

In other embodiments, a pair of mount bushings 310 may be disposed on both the forward and aft sides of segment bore 181, with an elongated pin 210 passing through a forward and aft mount bushing bores 314 and the segment bore 181 to connect each of the pair of mount bushings 310 to CMC seal segment 136. In such embodiments, mount bushings 310 may be referred to as mounting rings.

In some embodiments, carrier segment 134 further defines one or more carrier bores 303 in the one or more lateral flange 171 extending radially inward from axial flange 150. In such embodiments, carrier bores 303, mount bushing bores 314, and segment bores 181 are all in alignment with each other when carrier segment 134 and CMC seal segment 136 are assembled.

In some embodiments, a segment bore bushing 228 or radially compliant bushing 229 is disposed within segment bore 181. In some embodiments, mount bushing 310 is shaped as radially compliant bushing 229.

Figure 38:
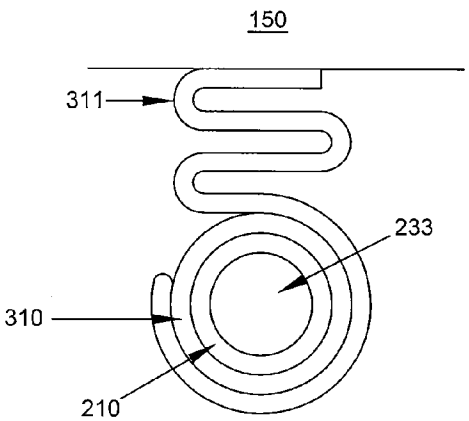
FIGS. 37, 38, and 39 are detailed radial profile views of a flexible member and mount bushing.
Figure 37:
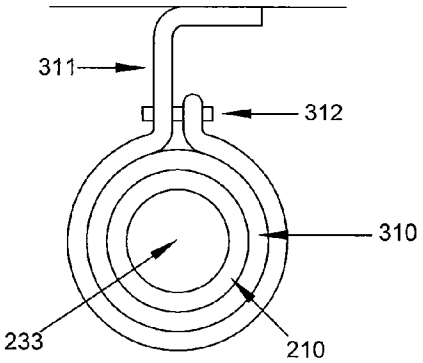
Figure 39:
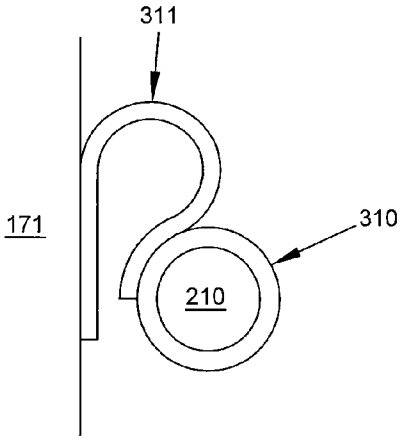

Additional exemplary embodiments for connecting a mount bushing 310 to carrier segment 134 are illustrated in FIGS. 37, 38, and 39. These figures each provide a detailed radial profile view of a flexible member 311 and mount bushing 310 in accordance with some embodiments.

In FIG. 37 a flexible member 311 is connected to axial flange 150 and extends radially inward to encircle mount bushing 310. Flexible member 311 is connected to axial flange 150 by welding or by an affixing means such as a screw, rivet, or bolt. In some embodiments a connector 312 such as a screw, bolt, or pin is provided to connect flexible member 311 to itself around mount bushing 310 as illustrated. An elongated pin 210, of hollow pin type P2 discussed above, is disposed within mount bushing 310 and defines a void 233.

In FIG. 38 a flexible member 311 having a continuously curved surface is connected to axial flange 150, extends generally radially inward, and is connected to mount bushing 310. Flexible member 311 is connected to axial flange 150 and to mount bushing 310 by welding or by an affixing means such as a screw, rivet, or bolt. In some embodiments, flexible member 311 encircles mount bushing 310. An elongated pin 210, of hollow pin type P2 discussed above, is disposed within mount bushing 310 and defines a void 233.

Although the exemplary embodiments of FIGS. 35, 36, 37, and 38 illustrate a flexible member 311 connected to axial flange 150, alternative embodiments are envisioned using similar geometries of flexible member 311 but wherein the flexible member 311 is connected to the one or more lateral flanges 171 extending radially inward from axial flange 150.

In FIG. 39 a flexible member 311 is arranged in an inverted U shape and connected between one or more lateral flanges 171 and mount bushing 310. Flexible member 311 is connected to one or more lateral flanges 171 and to mount bushing 310 by welding or by an affixing means such as a screw, rivet, or bolt. An elongated pin 210, of solid pin type P1 discussed above, is disposed within mount bushing 310.

In some embodiments, flexible member 311 is a helical or other spring connected between carrier segment 134 and mount bushing 310.

Figure 40:
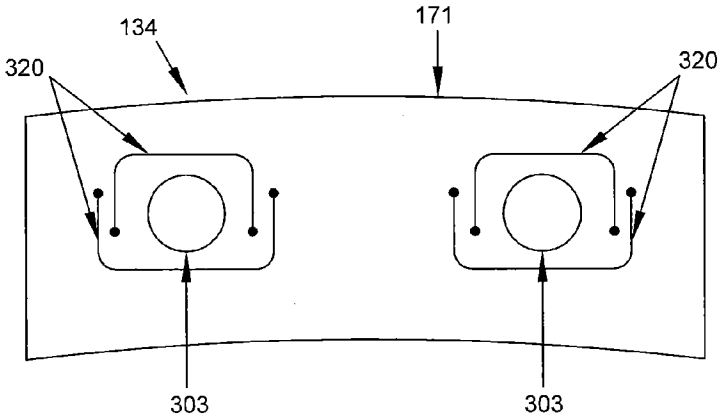
FIG. 40 is a radial profile view of a lateral flange defining a plurality of carrier bores and apertures.
Figure 41:
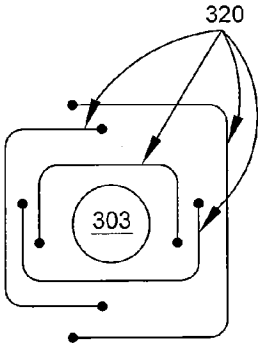
FIG. 41 is a detailed radial profile view of a carrier bore with proximate apertures.

In a further embodiment, flexible mounting is provided by a carrier segment 134 having one or more lateral flanges 171, 172 which define one or more carrier bores 303 and one or more apertures 320 adapted to effect radial flexion and positioned proximate one or more carrier bores 303. FIG. 40 is a radial profile view of a lateral flange 171 defining a plurality of carrier bores 303 and apertures 320 in accordance with some embodiments. FIG. 41 is a detailed radial profile view of a carrier bore 303 with proximate apertures 320 in accordance with some embodiments.

Each aperture 320 is adapted to effect radial, lateral, or axial flexion between the carrier bore 320 and an elongate pin 210 disposed therein. In some embodiments, apertures 320 have a uniform thickness. In other embodiments, apertures 320 have a varying thickness, for example as illustrated in FIGS. 40 and 41 where apertures include a bulbous portion at each end.

Apertures 320 can be of any number and any configuration or shape. One advantage of the thin line apertures 320 presented in FIGS. 40 and 41 is that they are self-limiting in their degree of deflection. The opposing edges of the aperture 320 will come into contact once a maximum deflection is achieved.

In some embodiments, carrier segment 134 is formed from a metal alloy and apertures 320 are machined into the one or more lateral flanges.

In some embodiments, a static seal cover such as that disclosed above is disposed over apertures 320 to ensure a sealed cavity 170 within the carrier segment 134.

The above-disclosed embodiments of flexibly mounting a CMC seal segment 136 to a carrier segment 134 provide numerous advantages over the prior art. For example, flexibly mounting a CMC seal segment 136 to a carrier segment 134 significantly reduces contact stresses and wear caused by disparate rates of thermal expansion between unlike material components. Reducing such stresses and wear can result in substantially longer component lifespans. Relative motion is permitted between the CMC seal segment 136 and carrier segment 134, but cavity sealing is still possible using compressible mating element 304, mating region 174, or buffering region 207 disclosed above.

Flexible mounting is also advantageous as it allows more than two elongated pins to be used to mount the CMC seal segment 136 to carrier segment 134. The previous limiting factor for CMC seal segment 136 length in the circumferential direction was the length between segment bores due to CMC seal segment flattening. CMC seal segments where thus required to be relatively short in circumferential length, requiring numerous inter-segment seals to maintain adequate sealing of the turbine shroud. With flexible mounting, additional pins are permitted and longer circumferential lengths of CMC seal segments are possible. Additional length results in fewer CMC seal segments required to complete the turbine shroud, and thus fewer inter-segment seals. In some embodiments, the flexible member 311 supporting each mount bushing 310 may comprise at least one element which is individually tuned to provide a different radial and circumferential spring rate dependent on the location of the pin bore flange 180 which will account for the flattening of the arc flange 182. Individually tuned flexible members 311 may be required to account for different loading stresses which would otherwise be present if a the flexible member 311 did not allow for more compliant mounting. These individually tuned spring rates may be designed to account for both the loading stress on the CMC segment 136 as well as blade tip clearance. In some embodiments, the spring rate in the radial direction is greater than 25,000 lbs./in., and, in designs in which more than two pins are used, the minimum radial spring rates is up to 60% less than the maximum radial spring rate.

In some embodiments, the CMC seal segments 136 described herein are manufactured using a two dimensional weave of SiC fibers and covered with additional SiC material. In other embodiments, additional materials known in the manufacture of CMC products, such as high nickelon fibers or high nicon Type S nippon carbon are used. In some embodiments, a three dimensional weave of fibers is used, or in some embodiment a combination of two dimensional weaves and three dimensional weaves are used.

Although examples are illustrated and described herein, embodiments are nevertheless not limited to the details shown, since various modifications and structural changes may be made therein by those of ordinary skill within the scope and range of equivalents of the claims.

What is claimed is:

1. A segmented turbine shroud for radially encasing a turbine in a gas turbine engine, the shroud comprising:

a carrier;

a ceramic matrix composite (CMC) seal segment comprising an arcuate flange having a surface facing the turbine and a portion defining a bore for receiving an elongated pin; and one or more elongated pins, wherein said CMC seal segment is carried by said carrier by at least one of said elongated pins being received within said bore, wherein said CMC seal segment portion defining a pin-receiving bore comprises a curved outer surface and is radially spaced from said arcuate flange by an elongated spacing flange extending radially outward from said arcuate flange, said elongated spacing flange having an axial dimension parallel to the axis of said bore and a lateral dimension less than the axial dimension of said flange and less than a lateral dimension of said portion defining the bore, and wherein said CMC seal segment portion defines a bore having a length that is at least 70% of the length of said elongated pin received therein.

2. The shroud of claim 1 wherein said pin receiving bore has a length that is at least 80% of the length of said elongated pin received therein.

3. The shroud of claim 1 wherein said pin receiving bore has a length that is at least 75% of a parallel dimension of said arcuate flange.

4. The shroud of claim 3 wherein said pin receiving bore has a length that is at least 90% of a parallel dimension of said arcuate flange.

5. The shroud of claim 1 wherein said elongated pin passes through only a single pin-receiving bore of said CMC seal segment.

6. The shroud of claim 1 wherein the curved outer surface of portion defining bore is coaxial with bore.

7. A segmented turbine shroud radially encasing a turbine in a gas turbine engine, said shroud comprising:

a carrier; and a ceramic matrix composite (CMC) seal segment carried by said carrier by a plurality of elongated pins, said CMC seal segment comprising an arcuate flange having an inner surface facing the turbine and an opposing outer surface and a plurality of radial members extending radially away from said outer surface, each of said radial members comprising a spacing portion and a portion defining an elongated pin-receiving bore at the distal end thereof, a radial dimension of said arcuate flange being a dimension between said inner surface and said opposing outer surface, wherein each of said radial members defines a pin-receiving bore having an axial length greater than the minimum radial dimension of said arcuate flange, and wherein said spacing portion has an axial dimension parallel to the axis of said bore and a lateral dimension less than the axial dimension of said flange and less than a lateral dimension of said portion defining said bore.

8. The shroud of claim 7 wherein each of said radial members defines a bore that is radially spaced from said outer surface of said arcuate flange a distance greater than the minimum radial dimension of said arcuate flange.

9. The shroud of claim 8 wherein each of said radial members defines a bore that is radially spaced from said outer surface of said arcuate flange a distance greater than twice the minimum radial dimension of said arcuate flange.

10. The shroud of claim 7 wherein at least one of said radial members defines a pin-receiving bore comprising a circular lateral cross-section.

11. The shroud of claim 7 wherein said CMC seal segment comprises at least three radial members defining pin-receiving bores.

12. The shroud of claim 7 wherein at least one of said radial members defines a pin-receiving bore having a length that is at least 70% of the length of an elongated pin received therein.

13. The shroud of claim 12 wherein at least one of said radial members defines a pin-receiving bore comprising a lateral cross-section dimension of at least three-eighths inches.

14. The shroud of claim 7 wherein at least one of said radial members defines a pin-receiving bore comprising a lateral cross-section dimension of at least three-eighths inches.

15. The shroud of claim 7 wherein at least one of said radial members defines a pin-receiving bore comprising a lateral cross-section dimension that varies along the length of said bore.

16. A segmented turbine shroud for radially encasing a turbine in a gas turbine engine, the shroud comprising: a carrier comprising a plurality of portions each defining a pin-receiving carrier bore; a ceramic matrix composite (CMC) seal segment comprising an arcuate flange having a surface facing the turbine and a plurality of tubular portions each defining a pin-receiving seal segment bore, each of said tubular portions being radially spaced from said arcuate flange by a spacing flange having an elongated axis parallel to the axis of the bore and a radial axis intersecting the axis of the bore; and a plurality of elongated pins, each of said pins passing through at least a carrier bore and a seal segment bore to thereby mount said CMC seal segment to said carrier.

* * * * *